US009524844B2

(12) United States Patent
Gratz

(10) Patent No.: US 9,524,844 B2
(45) Date of Patent: Dec. 20, 2016

(54) FUSE ARRANGEMENT AND A METHOD FOR MANUFACTURING A FUSE ARRANGEMENT

(71) Applicant: Infineon Technologies AG, Neubiberg (DE)

(72) Inventor: Achim Gratz, Dresden (DE)

(73) Assignee: INFINEON TECHNOLOGIES AG, Neubiberg (DE)

( * ) Notice: Subject to any disclaimer, the term of this patent is extended or adjusted under 35 U.S.C. 154(b) by 143 days.

(21) Appl. No.: 13/945,945

(22) Filed: Jul. 19, 2013

(65) Prior Publication Data

US 2015/0022310 A1 Jan. 22, 2015

(51) Int. Cl.

| | |
|---|---|
| ***H01H 85/54*** | (2006.01) |
| ***H01H 85/143*** | (2006.01) |
| ***H01H 85/36*** | (2006.01) |
| *H01H 85/30* | (2006.01) |
| *H01H 85/02* | (2006.01) |

(52) U.S. Cl.

CPC ..... *H01H 85/36* (2013.01); *H01H 85/30* (2013.01); *H01H 2085/0283* (2013.01)

(58) Field of Classification Search

CPC . H01H 85/36; H01H 85/30; H01H 2085/0283
USPC ..... 337/227, 238–240, 261, 297, 407
See application file for complete search history.

(56) References Cited

U.S. PATENT DOCUMENTS

| | | | | | |
|---|---|---|---|---|---|
| 2,790,049 | A * | 4/1957 | McAlister | H01H 37/761 | 337/405 |
| 3,198,914 | A * | 8/1965 | Baran | H01H 85/36 | 337/405 |
| 3,763,454 | A * | 10/1973 | Zandonatti | H01H 37/761 | 337/404 |
| 5,280,262 | A * | 1/1994 | Fischer | H01H 37/761 | 337/402 |
| 5,612,662 | A * | 3/1997 | Drekmeier | H01H 37/761 | 29/623 |
| 5,770,993 | A * | 6/1998 | Miyazawa | H01C 7/13 | 337/142 |
| 5,896,080 | A * | 4/1999 | Chen | H01H 37/761 | 337/401 |
| 5,999,391 | A * | 12/1999 | Lou | H02H 9/042 | 361/103 |
| 7,864,024 | B2 * | 1/2011 | Schlenker | H01H 37/761 | 337/239 |
| 8,143,991 | B2 * | 3/2012 | Yang | H01H 37/761 | 337/186 |

* cited by examiner

*Primary Examiner* — Anatoly Vortman

(57) ABSTRACT

A fuse arrangement, including: at least a first terminal, a second terminal, and a fuse, wherein the first terminal and the second terminal may be electrically connected via the fuse, and wherein the fuse may be configured to be under fuse internal mechanical stress to deform the fuse along its width direction in case it is broken.

23 Claims, 13 Drawing Sheets

1100

| state | error | C(204a-204b) | C(204a-414a) | C(204b-414b) | C(204a-414b) | C(204b-414a) | C(414a-414b) |
|---|---|---|---|---|---|---|---|
| D | F0 | no | no | yes | no | yes | yes |
| D | F0 | no | yes | no | yes | no | yes |
| D | E0 | no | no | no | no | yes | no |
| D | E0 | no | no | no | yes | no | no |
| D | 0 | no | yes | yes | no | no | no |
| D | F0 | no | no | yes | no | no | no |
| D | F0 | no | yes | no | no | no | no |
| D | F | no | no | no | no | no | no |
| 1 | 1 | yes | no | no | no | no | no |
| D | F | yes | no | yes | yes | no | no |
| D | F | yes | yes | no | no | yes | no |
| D | F | yes | yes | yes | yes | yes | yes |
| D | F | yes | no | no | no | no | yes |

FUSE ARRANGEMENT AND A METHOD FOR MANUFACTURING A FUSE ARRANGEMENT

TECHNICAL FIELD

Various embodiments relate generally to a fuse arrangement, a fuse array, a fuse testing arrangement, a method for manufacturing a fuse arrangement, and a method for operating a fuse arrangement.

BACKGROUND

In general a fuse may be used to limit a current in an electronic circuit. Therefore, a fuse may be designed to electrically conduct a certain current up to a maximum current, wherein the fuse, or e.g. the fuse filament, may break if the current exceeds the maximum current. While a fuse breaks, at least a part of the fuse or part of the fuse filament may be molten and may be evaporated, e.g. at least a part of the fuse filament material may be evaporated. Using conventional fuse arrangements, the molten and evaporated material of a broken fuse, so-called debris, may cause several problems, e.g. the debris may short-circuit a broken fuse or may electrically connect other parts of a fuse being for example arranged in the surrounding of the broken fuse. Further, a fuse may also be used to store information, e.g. in fuse arrangements and fuse arrays on chips, since a fuse may represent two states, first a "1"-state for the intact fuse conducting electrical current, and a "0"-state for the broken fuse not carrying electrical current.

SUMMARY

According to various embodiments, a fuse arrangement may be provided including at least a first terminal, a second terminal, and a fuse, wherein the first terminal and the second terminal may be electrically connected via the fuse, and wherein the fuse may be configured to be under fuse internal mechanical stress to deform the fuse along its width direction in case the fuse may be broken.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1A:
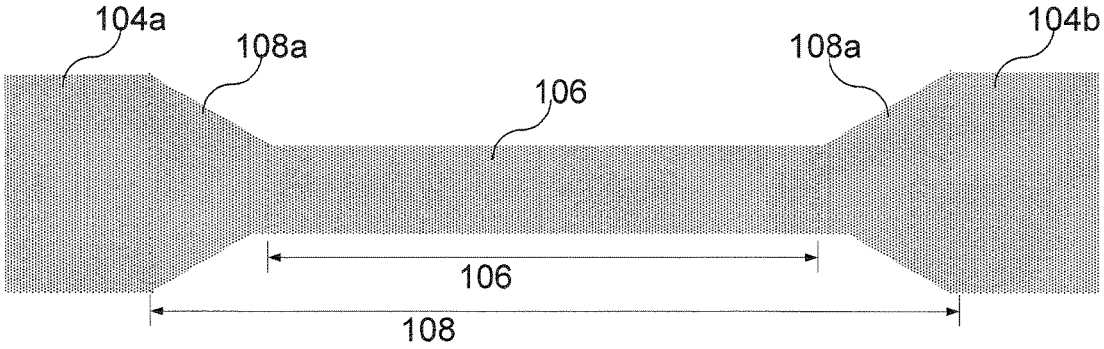
FIG 1A PRIOR ART
FIG. 1A schematically shows a conventional fuse in an intact state.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

According to various embodiments, a fuse may consist of a filament. According to various embodiments, a fuse may be a fuse filament. Further, according to various embodiments, a fuse filament may be also referred to as a fuse. According to various embodiments, a fuse may also be referred to as a fuse filament. According to various embodiments, a fuse may include a fuse filament.

Since a fuse may have more than one state, the fuse may be utilized to store information, e.g. similar to a memory cell, wherein a bit may be realized by a first state, defined by the intact fuse conducting electrical current and a second state defined by the broken fuse not carrying electrical current. Fuses have actually been one of the oldest programmable memory concepts in IC (integrated circuits) which may rely on breaking an electrically conductive filament by thermal energy. However, the reliability of electrically blown fuses may remain difficult to ascertain since there may be a tendency for a blown fuse to heal over time. According to various embodiments, a fuse arrangement, as described in the following, may be used in a device for storing data permanently, e.g. configured as a programmable read-only memory (PROM), a field programmable read-only memory (FPROM), or a one-time programmable non-volatile memory (OTP NVM). According to various embodiments, a fuse may store a bit and the programming of the fuse, e.g. storing a bit in the fuse, may be carried out after manufacturing of the fuse arrangement has been carried out, or even after manufacturing of a complete chip including the fuse arrangement has been carried out. According to various embodiments, a fuse, a fuse arrangement, and/or a fuse array may be programmed, e.g. by changing the state of one or more fuses from intact state to broken state to store the desired bit or bits.

According to various embodiments, the fuse may be provided in an intact state, e.g. representing the logic "1", wherein this state may be changed to the broken state, e.g. representing the logic "0". According to various embodiments, as described herein, it may not be important which state of the fuse may be referred to as "1" or "0", since the labeling of the two states may be assigned arbitrarily.

A fuse array, as described herein, may include a plurality of fuses (or fuse arrangements), e.g. up to several thousand fuses or even more, which may be used to permanently store data in the fuse array, wherein the fuse array may be for example arranged on a chip. This process of storing additional data on a chip may be performed after the chip manufacturing process itself may be finished such that additional data, e.g. calibration data, identification or configuration information, and the like, may be stored on the chip in a fuse array at a desired time. In general, writing data into a fuse array may be performed by applying a sufficiently high current to break the respective fuses to be changed to "0"-state. The fuse array may include information stored in the two states of the fuses, intact state ("1") and broken state ("0"). According to various embodiments, the intact state may also be referred to as blank state which may indicate that the fuse may be in an original non-programmed state. According to various embodiments, the broken state may also be referred to as burned state or blown state which may indicate that at least one of the fuse and the fuse filament may programmed, burned, blown and/or broken. However, since the reliability of electrically blown fuses remains difficult to ascertain, electrically blown fuses have fallen largely out of favor.

As shown in FIG. 1A, a fuse 108 may electrically connect a first terminal 104*a* with a second terminal 104*b* in an intact state. In this case, the state of the fuse 108 may be determined by passing an electrical current from the first terminal 104*a* to the second terminal 104*b*. If the fuse is passing the electrical current as intended, the fuse 108 may be detected as intact representing, as described above, the logic "1". On the other hand, if the electrical current is not passing through the fuse 108, the fuse 108 may be detected as broken, and accordingly representing the logic "0". It should be noted, that in this configuration the fuse may not break very reliably, which means that even if the fuse may be detected as broken, there may be a certain error in this detection which may not be negligible. Besides determining the state "1" and "0", there may be no way or it may be difficult to check the reliability of the determined state.

Figure 1B:
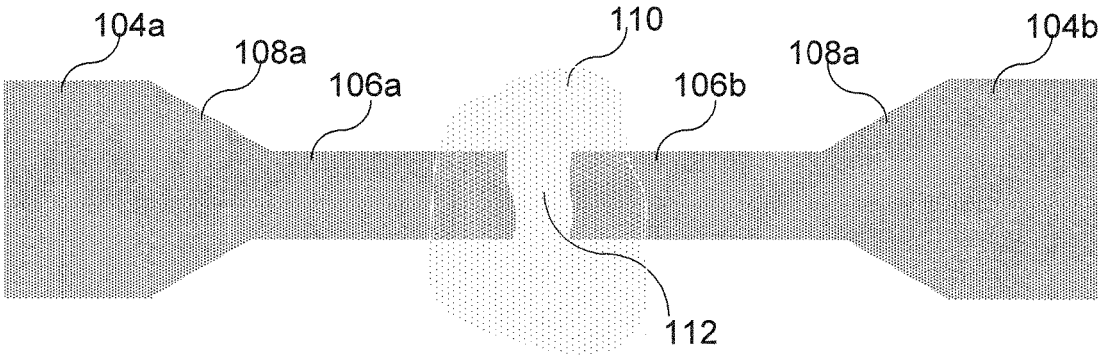
FIG 1B PRIOR ART
FIG. 1B schematically shows a conventional fuse in a broken state.

As shown in FIG. 1A and FIG. 1B, a fuse 108 may include a fuse filament 106. The cross section of the fuse 108 may be reduced in regions 108*a*, 108*b* to a specific value, e.g. to control the strength of electric current necessary for breaking the fuse as well as the breaking point of the fuse.

As shown in FIG. 1B, in general, a current may be used to break the fuse 108 (e.g. to write data into a fuse array) which may cause several problems. During breaking the fuse, material of the fuse, for example material in the region 112 of the fuse 108, may be molten, evaporated and/or distributed in the surrounding 110 of the fuse 108. This distributed electrically conductive material (debris) may electrically connect the respective terminals 104*a*, 104*b* of the fuse 108 or other adjacent fuses in a fuse array (not shown) such that, for example, over a certain time, the broken fuse 108 may pass a current from the first terminal 104*a* to the second terminal 104*b* again. Therefore, the gap 112 separating the adjacent parts 106*a*, 106*b* of the fuse 108 or the fuse filament 106 may not be stable over time. Referring to this, molten, evaporated and/or distributed material in the surrounding 110 of the gap 112 may rearrange over time, e.g. due to the present electric field near the broken parts 106*a*, 106*b* of the fuse 108.

Therefore, this process to break a fuse 108 may commonly not be used, since the reliability of the broken state may not be as high as desired and the electrically conductive material may be distributed in the surrounding of the fuse. The reliability of the states of the fuses in a fuse array may be crucial, since the stored data otherwise may not be long term stable or the storing of the data may even contain wrong information, which may cause various problems using for example chips including such a fuse array.

As an alternative writing process, the fuse may be changed from intact state ("1") to broken state ("0") by using a laser beam focused for example on the fuse 106. Blowing metal fuses with a laser may work, but may require a large area on a wafer. In this case, the fuse may definitely be destroyed due to the high power of a laser beam, and therefore this writing process may be more reliable. However, if a fuse array has to be written by a laser beam, the fuse array has to be designed space consuming with a large distance between the individual fuses since for example the reliability of a broken fuse actually depends on the amount of material removed by the energy of the laser pulse. Further, this writing process may generate the need of special equipment, which may be a problem if for example a customer shall be able to write specific data into the fuse array. In this case, the laser writing process to break a fuse may not be performed with a reasonable effort. Furthermore, the fuse array may be used on a chip, wherein in this case the laser writing may not be possible if the chip is packaged, and therefore, it may not be possible to write test results into a chip after the chip packaging has been finished. By necessity a laser-blown fuse may be exposed to the ambient and the reliability of certain materials in unfavorable environmental conditions may be still rather bad.

Various forms of electro migration have been used to provide fuses or fuse-like systems. These can be very reliable, however it may be difficult to control the fusing process and ascertain that it has worked as intended. The sketchy reliability of electrically blown fuses stems from the fact that the two ends of the blown filament may be still in close proximity. The distance can be increased by increasing the blow energy, but that melts and/or vaporizes more material that has a tendency to deposit in the vicinity of the filament.

According to various embodiments, a fuse arrangement may be provided in the following such that it may be possible to break the fuse with the lowest possible energy. This may rely on mechanical stress introduced into the fuse to move the ends of the broken fuse away from each other. This may require free space around the fuse. According to various embodiments, additional measures may be implemented to be able to check that the fusing process has indeed worked as intended. These also may provide intrinsic redundancy so that marginal fusing does not result in a field failure.

According to various embodiments, a fuse arrangement may be provided in the following, wherein the fuse may break, e.g. by applying a current, such that the evaporation of fuse material may be reduced or substantially prevented and therefore, the amount of produced debris during breaking the fuse may be reduced or may be substantially negligible. Further, according to various embodiments, the fuse design may allow the writing of data by an electrical current having an improved reliability, since the amount of debris created during the writing may be reduced or the creation of debris may be prevented. Therefore, according to various embodiments, the fuse arrangement, as described in the following, may have an improved functionality regarding the breaking of the fuse filament (e.g. regarding writing a "0"-state). Further, according to various embodiments, the fuse arrangement may include additional contacts, wherein the additional contacts may be used to check the state of the fuse in a more precise way, and therefore, additional data may be available to verify the state of the fuse.

Figure 2A:
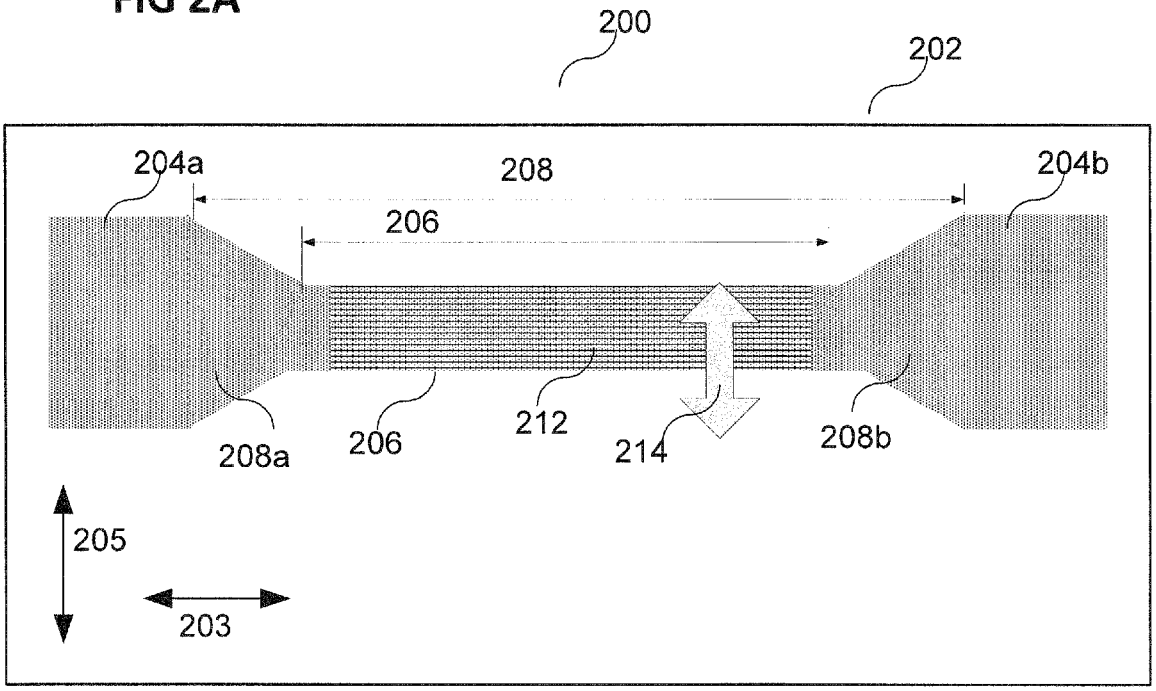
FIG. 2A schematically shows a fuse arrangement in an intact state being under internal mechanical stress, according to various embodiments.

FIG. 2A shows a top-view of a fuse arrangement 200, according to various embodiments. According to various embodiments, the fuse arrangement 200 as illustrated in FIG. 2A may be an intact fuse arrangement or a fuse arrangement 200 including an intact fuse. As shown in FIG. 2A, according to various embodiments, the fuse arrangement 200 may include at least a first terminal 204*a*, a second terminal 204*b*, and a fuse 208, wherein the first terminal 204*a* and the second terminal 204*b* may be electrically connected via the fuse 208, wherein the fuse 208 may be configured to be under fuse internal mechanical stress 212 to deform the fuse 208 along its width direction 214 in case the fuse 208 may be broken (cf. FIG. 2B). According to various embodiments, the fuse may include a fuse filament 206 and for example fuse elements 208*a*, 208*b* connecting the fuse filament with the terminals 204*a*, 204*b*. Since the functionality of the fuse may mostly depend on the fuse filament 206, the fuse filament 206 may be also referred to as fuse 206 in the following.

As shown in FIG. 2A, a fuse (and/or the fuse filament) 206 may electrically connect the first terminal 204*a* with a second terminal 204*b* in an intact state. In this case, the state of the fuse (and/or the fuse filament) 206 may be determined by passing an electrical current from one of the terminals 204*a*, 204*b* to the other one of the terminals 204*a*, 204*b*. If the fuse (and/or the fuse filament) 206 is passing the electrical current as intended, the fuse (and/or the fuse filament) 206 may be detected as intact representing, as described above, the logic "1". On the other hand, if the electrical current is not passing through the fuse (and/or the fuse filament) 206, the fuse (and/or the fuse filament) 206 may be detected as broken, and accordingly representing the logic "0".

According to various embodiments, the extension of the fuse (and/or the fuse filament) 206 along an electrically conducting path connecting the terminals 204*a*, 204*b* may be larger than the extension of the fuse (and/or the fuse filament) 206 along a direction perpendicular to the electrically conducting path connecting the terminals 204*a*, 204*b* of the fuse arrangement 200. As shown in FIG. 2A, the extension of the fuse (and/or the fuse filament) 206 along an electrically conducting path directly connecting the terminals 204*a*, 204*b* along a straight line (e.g. parallel to the direction 203) may be larger than the extension of the fuse (and/or the fuse filament) 206 along a direction perpendicular to the electrically conducting path connecting the terminals 204*a*, 204*b*, e.g. larger than an extension along a width direction of the fuse (and/or the fuse filament) 206 (e.g. direction 205 as shown in FIG. 2A), e.g. larger than an extension along a thickness direction of the fuse (and/or the fuse filament) 206 (e.g. direction 207 as shown in FIG. 2C).

According to various embodiments, the fuse arrangement 200 may be arranged on a carrier 202. According to various embodiments, the carrier 202 (e.g. a substrate 202, a wafer 202) may be made of semiconductor materials of various types, including silicon, germanium, Group III to V or other types, including polymers, for example, although in another embodiment, other suitable materials can also be used. In an embodiment, the carrier 202 is made of silicon (doped or undoped), in an alternative embodiment, the carrier 202 is a silicon on insulator (SOI) wafer. As an alternative, any other suitable semiconductor materials can be used for the carrier 202, for example semiconductor compound material such as gallium arsenide (GaAs), indium phosphide (InP), but also any suitable ternary semiconductor compound material or quaternary semiconductor compound material such as indium gallium arsenide (InGaAs).

According to various embodiments, the fuse arrangement 200 may be processed by semiconductor industry processes, e.g. layering, thin film deposition techniques, etching, doping, ion implantation, patterning, photolithography, and other known processes in semiconductor industry. Therefore, the fuse arrangement 200 may be formed by patterning a material layer (e.g. by patterning a fuse material layer) to form the terminals 204*a*, 204*b* and the fuse 206, 208 on the carrier 202. According to various embodiments, the fuse may be a thin film fuse.

According to various embodiments, the fuse (and/or the fuse filament) 206 may have a thickness in the range from about several nanometers to about several micrometers. According to various embodiments, the fuse (and/or the fuse filament) 206 may have a thickness smaller than about 3 μm, e.g. smaller than about 2 μm, e.g. smaller than about 1 μm. According to various embodiments, the minimal thickness of the fuse (and/or the fuse filament) 206 may be determined by the fabrication process. According to various embodiments, if the fuse (and/or the fuse filament) 206 is formed for example of a metal, such as aluminium, the fuse (and/or the fuse filament) 206 may have a thickness larger than about 30 nm. According to various embodiments, if the fuse (and/or the fuse filament) 206 is formed for example of a metallic material, such as titanium nitride, the fuse (and/or the fuse filament) 206 may have a thickness larger than about 10 nm. According to various embodiments, if the fuse (and/or the fuse filament) 206 is provided for example by graphene, such as a two-dimensional graphene sheet, the fuse (and/or the fuse filament) 206 may have a thickness smaller than about 0.1 nm (e.g. the thickness of a one-atom thick sheet). According to various embodiments, the thickness of the fuse (and/or the fuse filament) 206 may be the extension of the fuse (and/or the fuse filament) 206 perpendicular to the length direction of the fuse and perpendicular to the surface of the carrier 202.

Depending on the desired shape of the fuse (and/or the fuse filament) 206, and therefore the associated electrical properties, e.g. the electrical resistance and/or the defined breaking current of the fuse, the thickness of the fuse (and/or the fuse filament) 206 may demand a certain width of the fuse (and/or the fuse filament) 206 and/or a certain length of the fuse (and/or the fuse filament) 206.

According to various embodiments, the length of the fuse (and/or the fuse filament) 206 may be in the range from about several nanometers to about several hundreds of micrometers. According to various embodiments, the length of the fuse (and/or the fuse filament) 206 may be smaller than about 300 μm. According to various embodiments, the length of the fuse (and/or the fuse filament) 206 may be smaller than about 200 μm. According to various embodiments, the length of the fuse (and/or the fuse filament) 206 may be smaller than about 100 μm. According to various embodiments, the length of the fuse (and/or the fuse filament) 206 may be smaller than about 50 μm. According to various embodiments, the length of the fuse (and/or the fuse filament) 206 may be smaller than about 20 μm. According to various embodiments, the length of the fuse (and/or the fuse filament) 206 may be smaller than about 5 μm. According to various embodiments, the length of the fuse (and/or the fuse filament) 206 may be smaller than about 1 μm. According to various embodiments, as illustrated in FIG. 2A, the length of the fuse (and/or the fuse filament) 206 may be the extension of the fuse (and/or the fuse filament) 206 along the direction 203. According to various embodiments, as illustrated for example in FIG. 3A, the length of the fuse (and/or the fuse filament) 206 may be the extension of the fuse (and/or the fuse filament) 206 along the arc length of the electrically conducting path between the terminals.

According to various embodiments, the width of the fuse (and/or the fuse filament) 206 may be in the range from about several nanometers to about several hundreds of micrometers. According to various embodiments, the width of the fuse (and/or the fuse filament) 206 may be smaller than about 50 μm. According to various embodiments, the width of the fuse (and/or the fuse filament) 206 may be smaller than about 20 μm. According to various embodiments, the width of the fuse (and/or the fuse filament) 206 may be smaller than about 10 μm. According to various embodiments, the width of the fuse (and/or the fuse filament) 206 may be smaller than about 1 μm. According to various embodiments, the width of the fuse (and/or the fuse filament) 206 may be smaller than about 500 nm. According to various embodiments, the width of the fuse (and/or the fuse filament) 206 may be smaller than about 100 nm. According to various embodiments, the width of the fuse (and/or the fuse filament) 206 may be smaller than about 40 nm. According to various embodiments, as illustrated in FIG. 2A, the width of the fuse (and/or the fuse filament) 206 may be the extension of the fuse (and/or the fuse filament) 206 along the direction 205. According to various embodiments, the width of the fuse (and/or the fuse filament) 206 may be the extension of the fuse (and/or the fuse filament) 206 perpendicular to the length direction of the fuse and parallel to the surface of the carrier 202.

According to various embodiments, the dimensions of the fuse (and/or the fuse filament) 206 may only depend on the technical aspects, e.g. on the processes used for forming the fuse arrangement 200 for example in combination with the desired electrical properties of the fuse arrangement 200.

According to various embodiments, the fuse (and/or the fuse filament) 206 may include or may consist of at least one material of the following group of materials: a metal, a metallic material, an electrically conductive material, aluminium, copper, silver, gold, titanium, transition metal nitrides, titanium nitride, rare earth nitrides, doped silicon, doped polysilicon, carbon, graphene, metal alloys, and the like. According to various embodiments, the terminals 204*a*, 204*b* may include or may consist of the same material as the fuse (and/or the fuse filament) 206. According to various embodiments, the fuse 206, 208 and the terminals 204*a*, 204*b* may be formed in the very same process, e.g. using a layering process and a patterning process as usual in semiconductor industry. According to various embodiments, since the fuse may be formed by patterning a layer of a material as described above, the fuse may be formed by a fuse material layer including at least one material of said materials. According to various embodiments, the fuse arrangement 200 may include a layer stack deposited over the carrier 202, wherein the layer stack may at least include an oxide layer, an adhesion promoter layer, and a fuse material layer.

According to various embodiments, the terminals 204*a*, 204*b* may be used to electrically connect the fuse arrangement 200 to an external circuitry, e.g. to provide an electrical current to break the fuse 206 and/or e.g. to enable a measurement to check the state of the fuse 206. According to various embodiments, the fuse 206 may have a distinct electrical resistance defined by the design of the fuse 206 and the specific electrical resistivity of the fuse material.

According to various embodiments, the fuse (and/or the fuse filament) 206 may include a predetermined breaking point, e.g. a part of the fuse (and/or the fuse filament) 206 may have a smaller cross sectional area and therefore higher electrical resistance than the rest of the fuse (and/or the fuse filament) 206. According to various embodiments, the predetermined breaking point may be a notch included at a specific point of the fuse (and/or the fuse filament) 206 or any other type of weakness being appropriate to define a predetermined breaking point. According to various embodiments, the fuse arrangement 200, as shown in FIG. 2A and also in the following, may include a predetermined breaking point due to the design of the fuse (and/or the fuse filament) 206. Since heat may be transferred from the fuse (and/or the fuse filament) 206 to the terminals 204*a*, 204*b* the region of the fuse in the middle of the fuse 206 may have the smallest heat dissipation and therefore, if the fuse consists of a metal, the region in the middle of the fuse (and/or the fuse filament) 206 may cause the breaking of the fuse (and/or the fuse filament) 206 due to the design of the fuse arrangement 200.

According to various embodiments, the fuse (and/or the fuse filament) 206 may be configured to be under fuse internal mechanical stress 212. According to various embodiments, the fuse (and/or the fuse filament) 206 may be configured to be under fuse internal mechanical strain 212. According to various embodiments, the fuse (and/or the fuse filament) 206 may be configured to be under fuse internal compressive stress, e.g. along its length direction. According to various embodiments, the fuse (and/or the fuse filament) 206 may be configured to be under fuse internal mechanical stress 212 along its width direction 214. According to various embodiments, the fuse (and/or the fuse filament) 206 may be configured to be under fuse internal mechanical strain 212 along its width direction 214. According to various embodiments, in some cases it may be sufficient, if the fuse (and/or the fuse filament) 206 is only partially under fuse internal mechanical load, stress, and/or strain.

According to various embodiments, there may be several possibilities to introduce the desired stress and/or strain into the fuse (and/or the fuse filament) 206. As already described, the fuse 206 may be provided applying a layering process and a patterning process at least one of over and in the carrier 202. According to various embodiments, stress 212 and/or strain 212 may be introduced into the material of the fuse (and/or the fuse filament) 206 during the growth of the layer which may be subsequently patterned to provide the fuse (and/or the fuse filament) 206. According to various embodiments, stress 212 and/or strain 212 may be introduced into the material of the fuse (and/or the fuse filament) 206 during the growth of the fuse material layer along the growth direction of the fuse material layer. According to various embodiments, if the growth of the fuse material layer is provided along a direction perpendicular to the surface of the carrier, e.g. perpendicular to the direction 203, 205 as shown in FIG. 2A, e.g. along direction 207 as shown in FIG. 2C, the introduced stress 212 may also be directed into this direction perpendicular to the surface of the carrier. Therefore, to provide fuse internal mechanical stress 212 along the direction 214, the fuse (and/or the fuse filament) 206 may be formed by growing the fuse material layer such that the growth direction may be provided along the direction 214, e.g. along the width direction 205 as shown in FIG. 2A.

According to various embodiments, fuse internal mechanical stress 212 along the width direction 214 of the fuse (and/or the fuse filament) 206 may also be provided by using more than one material to form the fuse. According to various embodiments, the fuse (and/or the fuse filament) 206 may have a concentration gradient for at least one fuse layer material along the width direction of the fuse (and/or the fuse filament) 206, e.g. along the directions 207, 205 or a linear combination thereof.

According to various embodiments, fuse internal mechanical stress 212 along the width direction 214 of the fuse (and/or the fuse filament) 206 may also be provided by introducing an implant material into the fuse layer material. Therefore, according to various embodiments, a material may be implanted such that an implant material gradient may be provided along the width direction of the fuse (and/or the fuse filament) 206, e.g. along the directions 207, 205 or a linear combination thereof.

According to various embodiments, independently of the methods being utilized for forming the fuse (and/or the fuse filament) 206, the fuse (and/or the fuse filament) 206 may be configured to be strained or stressed, and therefore, the fuse (and/or the fuse filament) 206 may be configured to deform itself if the stress 212 and/or strain 212 is released. According to various embodiments, the fuse internal mechanical stress 212 may deliver power to deform the fuse (and/or the fuse filament) 206 along its width direction in case the fuse (and/or the fuse filament) 206 is broken. In other words breaking the fuse (and/or the fuse filament) 206 may release the fuse internal mechanical stress 212 or the fuse internal mechanical strain 212.

According to various embodiments, since the deformation of the fuse (and/or the fuse filament) 206 may be caused by the fuse internal mechanical stress 212, the deformation may also be directed into the same direction 214 as the fuse internal mechanical stress 212, e.g. at least in the first moment of breaking. According to various embodiments, the fuse (and/or the fuse filament) 206 may be deformed along its width direction, e.g. along the directions 207, 205 or a linear combination thereof, in case the fuse 206 is broken and/or the mechanical stress and/or strain is released.

According to various embodiments, the deformation of the fuse (and/or the fuse filament) 206 may be correlated with the specific fuse internal mechanical stress 212 provided in the fuse material layer. In other words, the fuse internal mechanical stress 212 may be configured to cause a desired deformation of the fuse (and/or the fuse filament) 206 in case the fuse is broken or in case the fuse breaks.

According to various embodiments, in case the fuse (and/or the fuse filament) 206 may have a connection to the carrier, the fuse (and/or the fuse filament) 206 or at least a part of the fuse (and/or the fuse filament) 206 may peel off the carrier if the fuse (and/or the fuse filament) 206 breaks and the fuse (and/or the fuse filament) 206 is deformed due to the fuse internal mechanical stress 212. According to various embodiments, the fuse material layer may include a material configured to provide a low adhesion to the carrier. According to various embodiments, the material being utilized for forming the fuse (and/or the fuse filament) 206 may be selected such that the adhesion to the carrier may be sufficiently low to enable the release and the deformation of at least a part of the fuse (and/or the fuse filament) 206 in case the fuse is broken.

According to various embodiments, the material being utilized for forming the fuse (and/or the fuse filament) 206 may be selected such that the thermal expansion coefficient between the carrier and the fuse material layer may be large, e.g. to provide a large fuse internal mechanical stress 212. According to various embodiments, the material being utilized for forming the fuse (and/or the fuse filament) 206 may be selected such that the thermal expansion coefficient between the carrier 202 and the fuse material layer may be sufficiently unequal providing a sufficiently large fuse internal mechanical stress 212 to enable the release and the deformation of at least a part of the fuse (and/or the fuse filament) 206 in case the fuse 206 is broken.

According to various embodiments, to provide a low adhesion of the fuse (and/or the fuse filament) 206 to the carrier 202 a gap may be arranged between the fuse (and/or the fuse filament) 206 and the carrier 202. According to various embodiments, to provide a low adhesion of the fuse (and/or the fuse filament) 206 to the carrier 202 the fuse (and/or the fuse filament) 206 may be at least partially freestanding as for example shown in FIG. 2C.

Figure 2B:
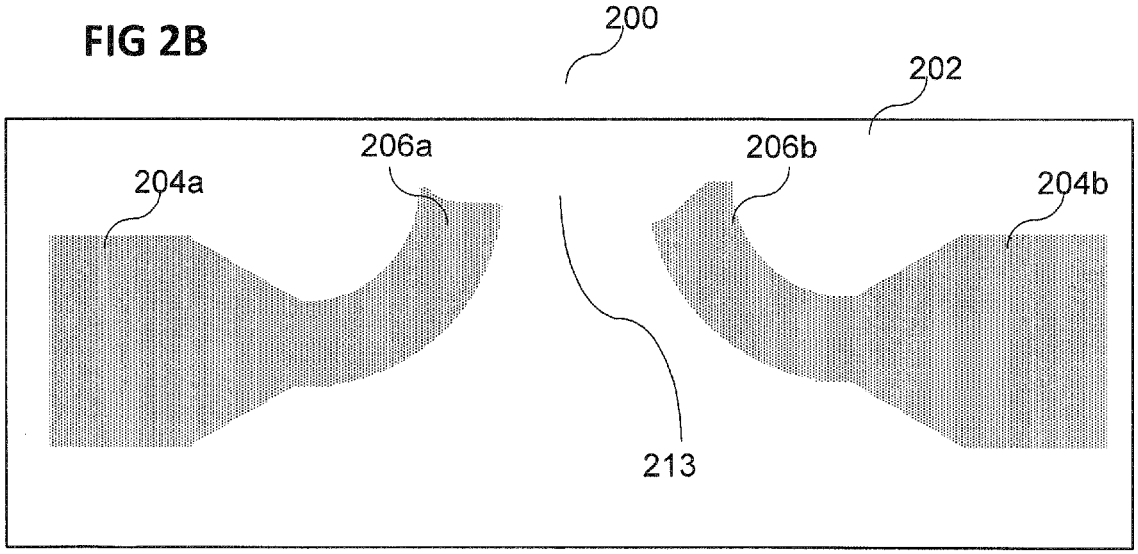
FIG. 2B schematically shows a deformed fuse in a fuse arrangement in a broken state, according to various embodiments.
Figure 2C:
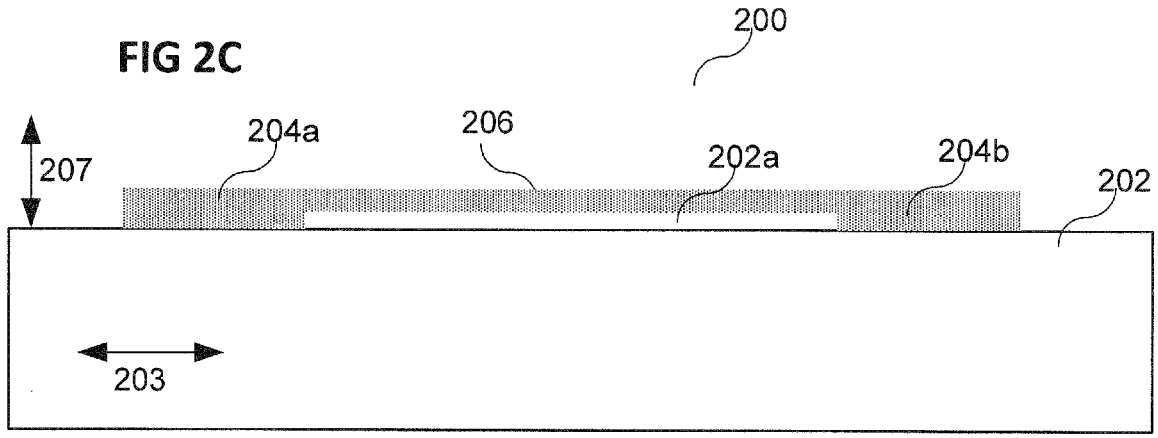
FIG. 2C schematically shows a cross section of a fuse arrangement in an intact state having a gap between the fuse and the carrier, according to various embodiments.

FIG. 2B shows an exemplary illustration of a fuse arrangement 200, wherein the fuse 206 is broken. According to various embodiments, the fuse (and/or the fuse filament) 206 may be deformed along its width 214 direction. According to various embodiments, the shape of the fuse (and/or the fuse filament) 206 after the deformation, as shown in FIG. 2B, may be determined by the fuse internal mechanical stress and/or strain. Due to the introduced fuse internal mechanical stress and/or strain there may be a new equilibrium for the fuse (and/or the fuse filament) 206 such that a deformation takes place as long as the equilibrium is not reached. According to various embodiments, the state of equilibrium may be regarded as the state, wherein the fuse internal mechanical stress and/or strain may be substantially zero. According to various embodiments, the fuse internal mechanical stress and/or strain may be reduced by the deformation of the fuse (and/or the fuse filament) 206.

According to various embodiments, the deformation of the fuse (and/or the fuse filament) 206 may start from the intact state of the fuse (and/or the fuse filament) 206, as shown in FIG. 2A and may end in the equilibrium state, the broken state, as shown in FIG. 2B.

It should be noted, that in this configuration, including a fuse (and/or the fuse filament) 206 under internal mechanical stress, the fuse (and/or the fuse filament) 206 may break very reliably. Due to the deformation of the fuse (and/or the fuse filament) 206 during breaking, the two broken parts 206*a*, 206*b* of the broken fuse (and/or the fuse filament) 206 may have a larger distance between each other, than for example for common fuses (not being under fuse internal mechanical stress) as shown in FIG. 1B.

It should be noted that the fuse internal mechanical stress 212 of the fuse (and/or the fuse filament) 206 included in the fuse arrangement 200, as described herein, may not be introduced by an external force. Instead, the fuse internal mechanical stress 212 may be introduced into the fuse (and/or the fuse filament) 206 by at least one of the following effects: stress and/or strain resulting from the growth of the fuse material layer, e.g. distortions in the crystal structure; stress and/or strain resulting from thermal expansion or thermal compression, e.g. stress introduced by thermal processes during the growth of the fuse material layer; stress and/or strain introduced by a doping concentration gradient; stress and/or strain introduced by a material concentration gradient; stress and/or strain introduced by using various materials, e.g. a layer stack of more than one material for providing the fuse material layer; stress and/or strain introduced by using the same material but applying different layering conditions, e.g. depositing various layers of the same fuse layer material using different deposition conditions (e.g. different temperatures, different growth speeds, different pressures, and the like).

Referring to FIG. 2B, a current may be used to break the fuse (and/or the fuse filament) 206 (e.g. to store a bit in the fuse 206 or in the fuse arrangement 200). During this process, the amount of material being molten, evaporated and/or distributed in the surrounding of the fuse 206 may be substantially negligible, since the breaking of the fuse (and/or the fuse filament) 206 may be supported by the deformation of the fuse (and/or the fuse filament) 206. Therefore, the electrically conductive material (debris) may not be produced in such a large amount that the debris may electrically connect the respective terminals 204*a*, 204*b* of the fuse arrangement 200. Therefore, the gap 213 separating the adjacent parts 206*a*, 206*b* of the broken fuse may be stable over time. Further, according to various embodiments, the gap 213 separating the adjacent parts 206*a*, 206*b* of the broken fuse (and/or the fuse filament) may be larger than a gap of a fuse being not under fuse internal mechanical stress, e.g. a common fuse. Therefore, according to various embodiments, breaking the fuse 206 using an electrical current may be used to establish a reliable broken state (as shown in FIG. 2B). Further, according to various embodiments, the fuse (and/or the fuse filament) 206 may break in the middle of the fuse, supported by the fuse internal mechanical stress 212.

According to various embodiments, the deformation of the fuse (and/or the fuse filament) 206 may be in-plane with the surface of the carrier 202. According to various embodiments, the deformation of the fuse (and/or the fuse filament) 206 may be out-of-plane from the surface of the carrier 202. According to various embodiments, the deformation of the fuse (and/or the fuse filament) 206 may be perpendicular to the surface of the carrier 202. According to various embodiments, the deformation of the fuse (and/or the fuse filament) 206 may be directed in any direction having at least a component along the width direction of the fuse (and/or the fuse filament) 206.

According to various embodiments, the fuse internal mechanical stress 212 may be inhomogeneously distributed. According to various embodiments, the deformation of the broken parts 206*a*, 206*b* of the fuse 206 may not be symmetrically as illustrated in FIG. 2B. It should be noted, that the deformation as shown in FIG. 2B may be regarded as a desired deformation supported by the design of the fuse arrangement 200. According to various embodiments, there may be the case, as described later, that the fuse may also break in other configurations due to errors or deviations from normal conditions, e.g. deviations from desired conditions during the layering or patterning of the fuse (and/or the fuse filament) 206.

According to various embodiments, the fuse internal mechanical stress 212 and/or strain 212 may be compensated by an external force, e.g. provided by the mechanical properties of the fuse (and/or the fuse filament) 206, such that as long as the fuse (and/or the fuse filament) 206 may be intact (not broken) the fuse (and/or the fuse filament) 206 is not being deformed by the fuse internal mechanical stress 212 and/or strain 212. It should be noted, that the external force may not primarily generate the stress 212 and/or strain 212 within the fuse, the external force may rather prevent the fuse (and/or the fuse filament) 206 from being deformed by the fuse internal forces.

As shown in FIG. 2C, a gap 202*a* may be arranged between at least a portion of the fuse (and/or the fuse filament) 206 and the carrier 202. According to various embodiments, the terminals 204*a*, 204*b* may have a contact to the carrier 202. According to various embodiments, the gap 202*a* may thermally isolate the fuse (and/or the fuse filament) 206 from the carrier 202 which may reduce the current needed for breaking the fuse (and/or the fuse filament) 206, since the heat dissipation from the fuse (and/or the fuse filament) 206 may be lower.

According to various embodiments, the fuse (and/or the fuse filament) 206 or the fuse arrangement 200 may be designed to provide a fuse (and/or the fuse filament) 206 in such a way, that the fuse (and/or the fuse filament) 206 may break with the smallest possible and/or applicable energy. Therefore, according to various embodiments, the fuse (and/or the fuse filament) 206 may have at least one of a high electrical resistance, a predetermined breaking point, a large fuse internal stress, and low heat dissipation to the surrounding.

According to various embodiments, the gap 202*a* between at least a part of the carrier 202 and the fuse (and/or the fuse filament) 206 may lower the adhesion of the fuse (and/or the fuse filament) 206 to the carrier such that the fuse (and/or the fuse filament) 206 may be released from the carrier 202 in case it is broken. According to various embodiments, a fuse (and/or the fuse filament) 206 having a lower adhesion to the carrier 202 may be configured to have a smaller amount of fuse internal mechanical stress 212.

Figure 2D:
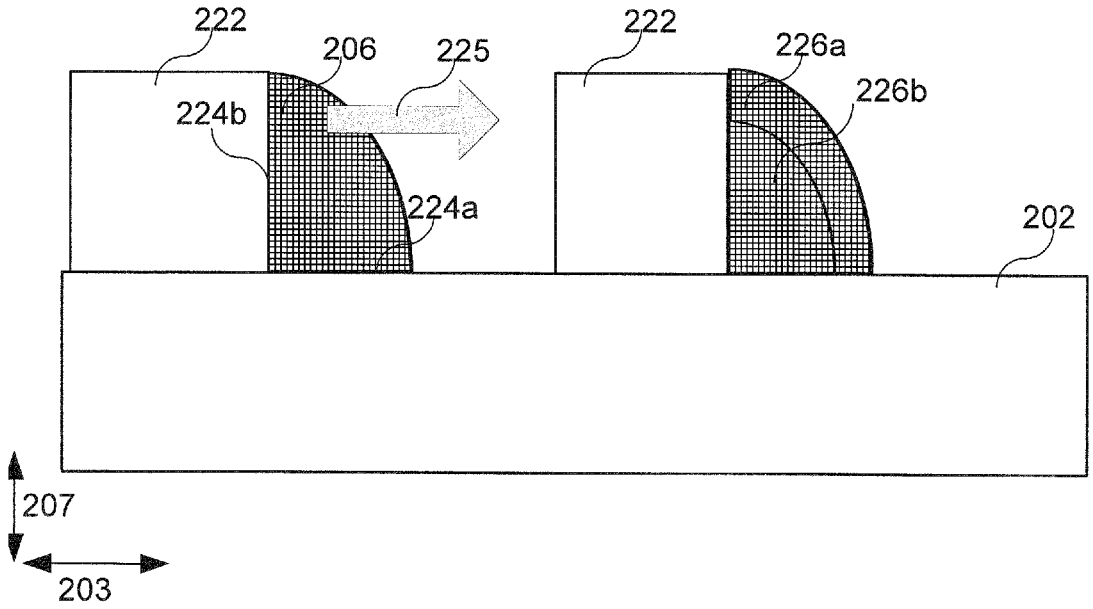
FIG. 2D schematically shows a cross section of a fuse on a carrier being formed by a spacer structure, according to various embodiments.

As already mentioned, the fuse (and/or the fuse filament) 206 may be formed by using a layering process as usual in semiconductor industry. Further, according to various embodiments, a fuse internal mechanical stress may be provided by the growth of the fuse material layer. According to various embodiments, the fuse (and/or the fuse filament) 206 may be provided by growing a fuse material layer, wherein the growth direction may be in-plane with the main processing surface of a wafer. As shown in FIG. 2D, according to various embodiments, this may be realized using a spacer technology.

FIG. 2D shows a carrier 202 including carrier structure 222, wherein the carrier structure 222 may be provided by commonly used semiconductor processing, e.g. layering and patterning. According to various embodiments, the carrier structure 222 may be used to deposit a spacer structure such that the spacer layer grows at least partially in-plane to the carrier surface, e.g. along the direction 225.

According to various embodiments, a material layer may be deposited at least partially over the carrier 202 and the carrier structure 222, e.g. using a conformal deposition process. According to various embodiments, a conformally deposited thin film or a conformally deposited layer of a material (e.g. a spacer layer) may include a film or a layer which may exhibit only small thickness variations along the interface with another body, e.g. the film or the layer may exhibit only small thickness variations along edges, steps or other elements of the morphology of the interface. According to various embodiments, layering processes such as plating or several CVD processes (e.g. LPCVD, ALCVD, ALD) may be suitable to generate a conformal thin film or a conformally deposited layer of a material.

According to various embodiments, a subsequently performed patterning process may be used to provide a sidewall spacer fuse 206. Since the growth direction 225 may also be the direction for the fuse internal mechanical stress 212, the sidewall spacer fuse 206 may deform along the direction 225 if the fuse 206 is broken, according to various embodiments.

As shown in FIG. 2D, a fuse (and/or the fuse filament) 206 may include more than one layer of fuse material, e.g. two layers 226*a*, 226*b*. According to various embodiments, layers 226*a*, 226*b* or all layers may be formed using a spacer technology. According to various embodiments, using more than one layer or a layer stack may further increase the fuse internal mechanical stress and/or strain.

According to various embodiments, a sidewall spacer structure may be used for growing the fuse (and/or the fuse filament) 206 along an in-plane direction 225 to provide a fuse (and/or the fuse filament) 206 being under fuse internal mechanical stress 212, wherein the fuse (and/or the fuse filament) 206 may be deformed or may deform along the growth direction 225 in case the fuse (and/or the fuse filament) 206 may be broken or may break.

According to various embodiments, the carrier structure 222 may include a different material than the carrier 202. According to various embodiments, the carrier structure 222 may include the same material as the carrier 202. According to various embodiments, the material of the carrier 202 and/or the material of the carrier structure 222 may be selected to provide optimal properties in combination with the fuse layer material, e.g. to provide a low adhesion between the carrier 202 and the fuse 206 and/or provide a low adhesion between the carrier structure 222 and the fuse 206.

According to various embodiments, the fuse (and/or the fuse filament) 206 may be formed from the fuse material layer by patterning, e.g. using at least one etch process. According to various embodiments, the etch process may include dry etching or wet etching. According to various embodiments, the etch process may include an etch process being selective to the material of the carrier 202. According to various embodiments, the etch process may include an etch process being selective to the material of the carrier structure 222. According to various embodiments, the etch process may include an etch process being selective to the material of the carrier structure 222 and the material of the carrier 202. Therefore, according to various embodiments, the fuse (and/or the fuse filament) 206 may be patterned using undercutting of the fuse 206 to at least partially expose a side of the fuse (and/or the fuse filament) 206 adjacent to the carrier 202 and/or adjacent to the carrier structure 222. According to various embodiments, the surface 224*a* and/or the surface 224*b* may be at least partially exposed during patterning the fuse (and/or the fuse filament) 206.

According to various embodiments, the carrier structure 222 may be removed in some cases after the fuse (and/or the fuse filament) 206 may be patterned, e.g. to provide a region to allow the deformation of the fuse (and/or the fuse filament) 206.

According to various embodiments, the shape of the carrier structure 222 may be adapted to provide the desired growth direction of the fuse material layer. According to various embodiments, the carrier structure 222 may be adapted to provide the desired design of the fuse arrangement 200, e.g. a linear connection between the terminals, as shown in FIG. 2A, or a rounded shaped connection between the terminals, as shown in the following FIG. 3A.

According to various embodiments, the fuse (and/or the fuse filament) 206, as shown in FIG. 2D, may have a different shape than shown, e.g. depending on the etch process conditions for forming the sidewall spacer 206.

The fuse arrangement 200 described referring to FIG. 2A to FIG. 2D may provide basic features and functionalities included in the fuse arrangements 200 (or fuse arrays) shown and described in the following. According to various embodiments, there may be various possibilities to provide a fuse arrangement including a fuse being subjected to fuse internal mechanical stress and/or strain. According to various embodiments, using for example the spacer technology, a fuse (and/or the fuse filament) 206 may be formed being under fuse internal mechanical stress and/or strain along the width direction of the fuse.

Figure 3A:
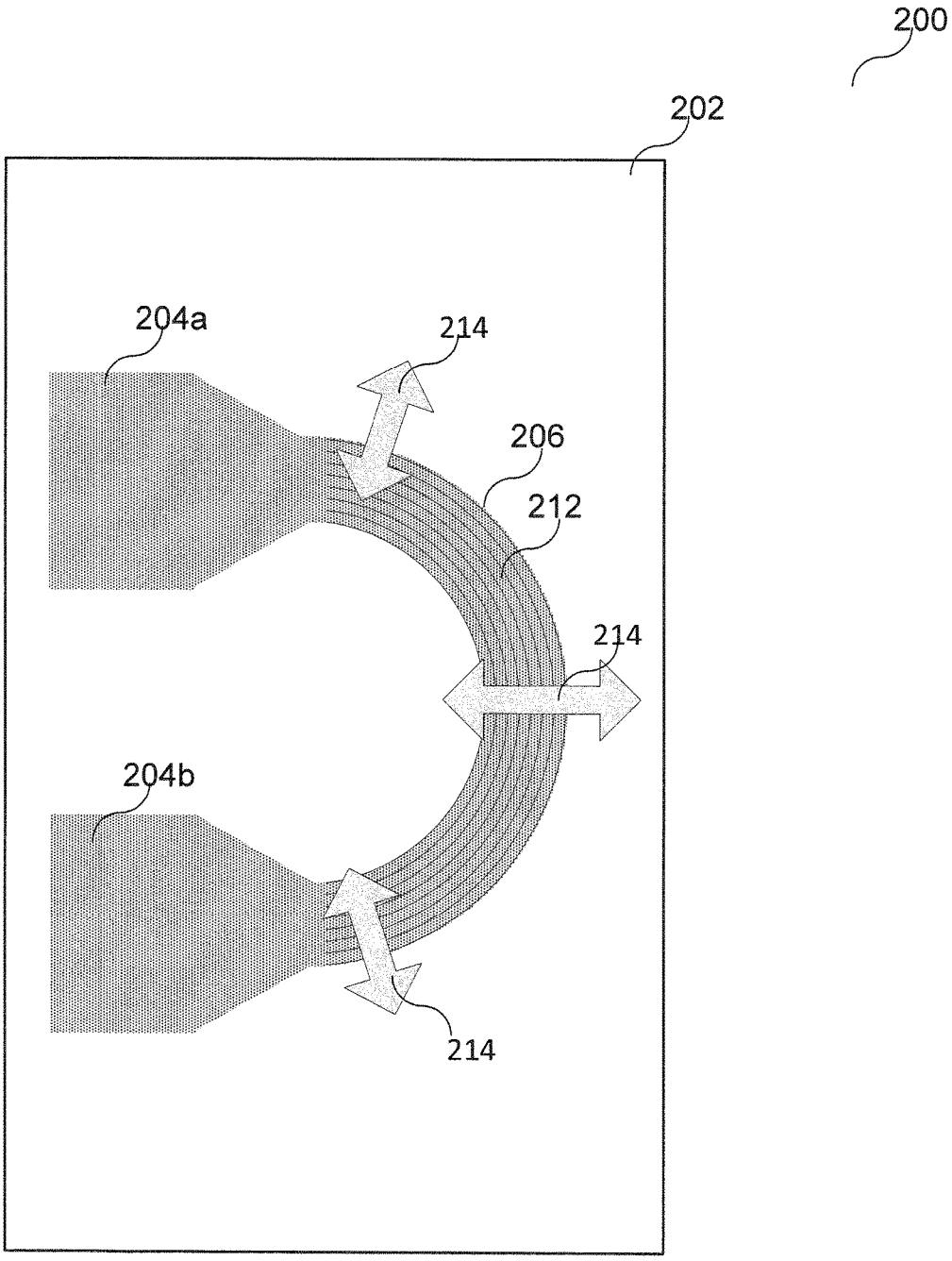
FIG. 3A schematically shows a fuse arrangement in an intact state being under internal mechanical stress, according to various embodiments.

FIG. 3A shows an alternative configuration of a fuse arrangement 200, according to various embodiments. The terminals 204*a*, 204*b* may be electrically connected via the fuse (and/or the fuse filament) 206, according to various embodiments. The fuse (and/or the fuse filament) 206 may be configured to be under fuse internal mechanical stress 212. According to various embodiments, the fuse internal mechanical stress 212 may be configured to be directed along the width direction 214 of the fuse (and/or the fuse filament) 206. According to various embodiments, the fuse internal mechanical stress 212 configured to be directed along the width direction 214 of the fuse (and/or the fuse filament) 206 may be provided by growing the fuse (and/or the fuse filament) 206 using a spacer technology, as described before.

According to various embodiments, the fuse arrangement 200 may include other configurations, e.g. including at least two terminals and a fuse (and/or the fuse filament) 206 electrically connecting the at least two terminals along a connection path. According to various embodiments, the connection path between the at least two terminals may be arbitrarily shaped, wherein the fuse (and/or the fuse filament) 206 may be configured to be under fuse internal mechanical stress such that the fuse (and/or the fuse filament) 206 may be deformed if the fuse (and/or the fuse filament) 206 is broken.

Figure 3B:
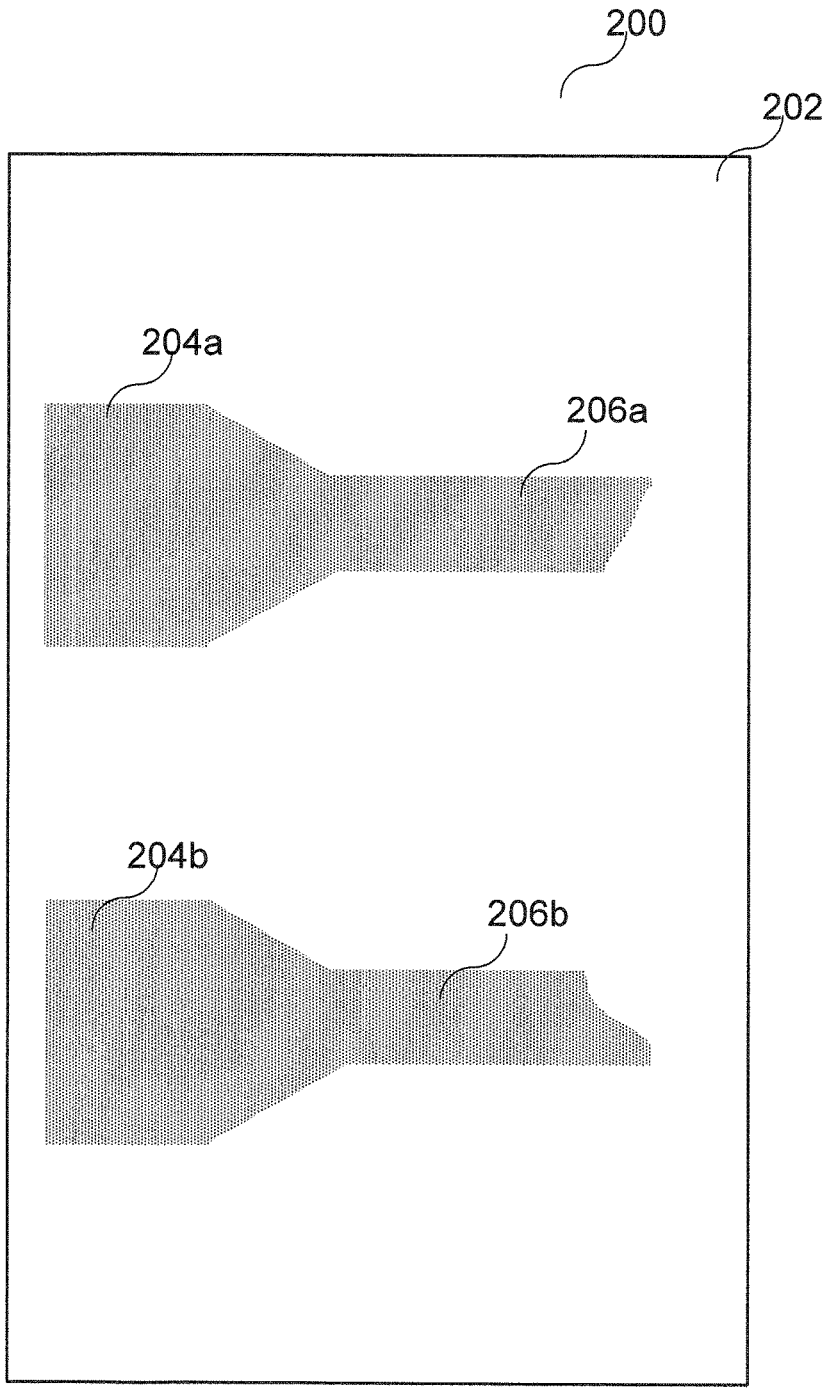
FIG. 3B schematically shows a deformed fuse in a fuse arrangement in a broken state, according to various embodiments.

Referring to FIG. 3A, FIG. 3B shows the fuse arrangement 200 in a broken state. The parts 206*a*, 206*b* of the broken fuse (and/or the fuse filament) 206 may be deformed as illustrated. According to various embodiments, the illustrated arrangement of the broken parts 206*a*, 206*b* of the fuse (and/or the fuse filament) 206 may be the equilibrium state of the fuse, wherein substantially no external force may compensate the fuse internal mechanical stress 212 and/or strain 212.

According to various embodiments, the fuse (and/or the fuse filament) 206 may be mechanically loaded so that the two ends 206*a*, 206*b* of the fuse (and/or the fuse filament) 206 of a blown fuse will move away from each other. According to various embodiments, the mechanical load 212 may be provided by residual film stress.

According to various embodiments, the increased distance between the ends 206*a*, 206*b* of the blown fuse (and/or the fuse filament) 206 may improve the reliability of the fuse arrangement 200 as it may become much more difficult to provide an electrically conductive path between them. According to various embodiments, the space around the fuse (and/or the fuse filament) 206 may be a hermetically sealed cavity (or a hollow chamber) to maximize reliability of the fuse. According to various embodiments, the cavity may additionally restrict the movement of the filament ends 206*a*, 206*b* in one dimension. According to various embodiments, the mechanical load may be preferably introduced by residual mechanical stress in the filament, which may be achieved for instance by controlling the deposition parameters of thin films or by composition of the filament out of different materials, at least one of which must be conductive.

According to various embodiments, the fuse may be designed so that the moving ends 206*a*, 206*b* of the blown fuse make contact to additional contacts, as described in the following. According to various embodiments, by choosing the material properties of these contacts and the filament and using proper current densities, the filament can be welded to at least one of these additional contacts to obtain a more stable connection. According to various embodiments, in this manner it may be assessed that the fuse 206 has been blown correctly, especially that the break occurred at the correct position and that the ends 206*a*, 206*b* moved away from each other as intended. According to various embodiments, this may be done by checking connectivity between all contacts of the fuse element against a template, e.g. using an external testing circuitry.

Figure 4A:
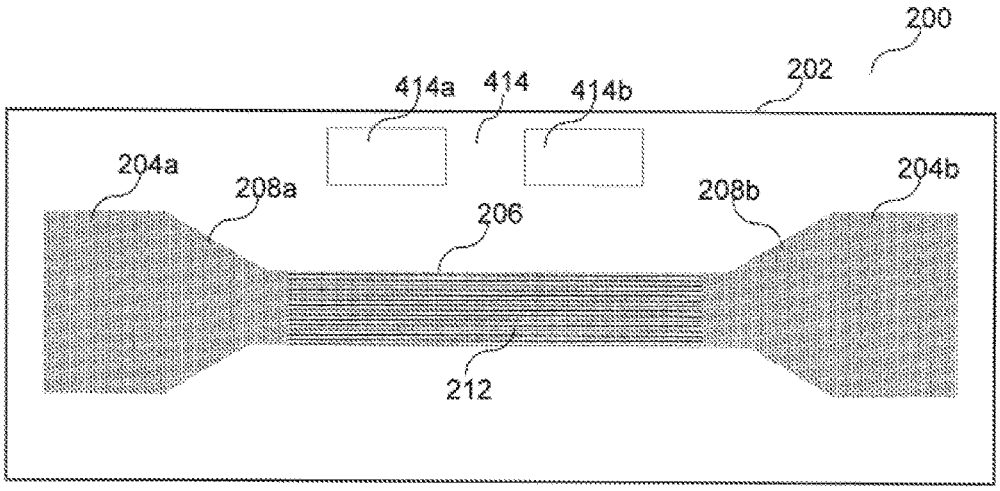
FIG. 4A schematically shows an intact fuse in a fuse arrangement including a contact structure, according to various embodiments.

According to various embodiments, as shown in FIG. 4A, the fuse arrangement 200 may include a contact structure 414. The fuse arrangement 200, as described herein, may be shown having two or four individual contacts within the contact structure, however, the number of individual contacts 414*a*, 414*b* included in the contact structure may be arbitrary and adapted to the specific use if the fuse arrangement 200, wherein the number of individual contacts may be in the range from about 1 to about 20, or the number of individual contacts may even be larger than 20. Further, the individual contacts 414*a*, 414*b* of the contact structure 414 may be illustrated herein rather symmetric, which may be not the case if it is desired or intended to be useful.

Figure 4B:
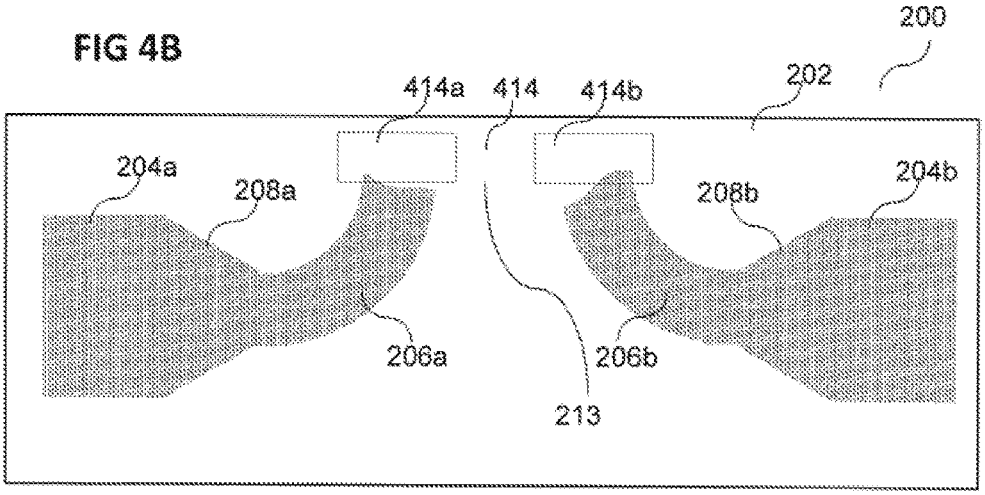
FIG. 4B schematically shows a deformed fuse in a fuse arrangement including a contact structure, according to various embodiments.

According to various embodiments, the contact structure 414 may be configured to provide an interface to an evaluation circuit to determine the state of the fuse 206 (or the state of the fuse arrangement 200). According to various embodiments, the individual contacts 414*a*, 414*b* of the contact structure 414 may serve to measure an electrical resistance between the terminals and the individual contacts 414*a*, 414*b* of the contact structure 414. In one case, for example, the fuse (and/or the fuse filament) 206 may be broken as intended, e.g. being deformed along the width direction of the fuse (and/or the fuse filament) 206, as shown in FIG. 4B, such that the broken parts 206*a*, 206*b* of the fuse may provide an electrically conductive connection between the terminals 204*a*, 204*b* and the individual contacts 414*a*, 414*b* of the contact structure 414. Therefore, measuring the resistance between the terminals 204*a*, 204*b* and the individual contacts 414*a*, 414*b* of the contact structure 414 may provide a possibility to determine, if the fuse (and/or the fuse filament) 206 is broken as intended, and if the gap 213 between the broken parts 206*a*, 206*b* of the fuse (and/or the fuse filament) 206 is as large as desired. There may be various possibilities to check, whether the fuse (and/or the fuse filament) 206 may be broken as intended and whether the broken parts 206*a*, 206*b* of the fuse (and/or the fuse filament) 206 may be deformed along the width direction of the fuse (and/or the fuse filament) 206 providing a large gap 213.

According to various embodiments, as already described, providing a sufficiently high current between the individual contacts 414*a*, 414*b* of the contact structure 414 and the terminals 204*a*, 204*b* may weld the broken parts 206*a*, 206*b* of the fuse (and/or the fuse filament) 206 to the respective contacts 414*a*, 414*b* of the contact structure 414, e.g. providing a long term stable broken fuse.

According to various embodiments, the evaluation circuit may first check if the fuse (and/or the fuse filament) 206 is broken by measuring the electrical resistance between the terminals. The broken state of the fuse may be detected, if the electrical resistance is significantly higher than the electrical resistance of the intact fuse as designed, e.g. the electrical connection may be interrupted and the electrical resistance may be substantially infinite. The intact state of the fuse may be detected, if the electrical resistance is substantially the electrical resistance of the fuse as it should be correlated to the design of the fuse arrangement 200. Since the individual contacts 414*a*, 414*b* of the contact structure 414 may provide more possibilities to check the state of the fuse, the fuse arrangement 200 including the at least one contact structure may provide a more reliable measurement of the state of the fuse than common fuses or common fuse arrangements. If there is for example an electrically conductive connection between the terminal 204*a* and the contact 414*a*, and an electrically conductive connection between the terminal 204*b* and the contact 414*b*, the fuse may be broken as intended (deformed along its width direction due to the fuse internal mechanical stress 212). A few examples for testing possibilities are described later, based on standard error correction.

According to various embodiments, the fuse (and/or the fuse filament) 206 may be deformed along a deformation vector in case the fuse is broken. According to various embodiments, the deformation vector may describe the movement of the respective regions of the fuse (and/or the fuse filament) 206 beginning from the intact state to the equilibrium state. According to various embodiments, the deformation vector may include vector components, e.g. a linear combination of three linearly independent base vectors, wherein at least one of the vector components of the deformation vector may be perpendicular to the length direction of the fuse. In other words, in a case that the terminals are electrically connected along a straight line via the fuse (and/or the fuse filament) 206, as shown in FIG. 2A in FIG. 4A, at least one of the vector components may be perpendicular to the line connecting the terminals. In the case that the terminals are electrically connected via the fuse 206 along a curved or arbitrary shaped connection, as for example shown in FIG. 3A and FIG. 5A, at least one of the vector components may be perpendicular to a line tangential to the connection path between the terminals at the breaking point.

Figure 4C:
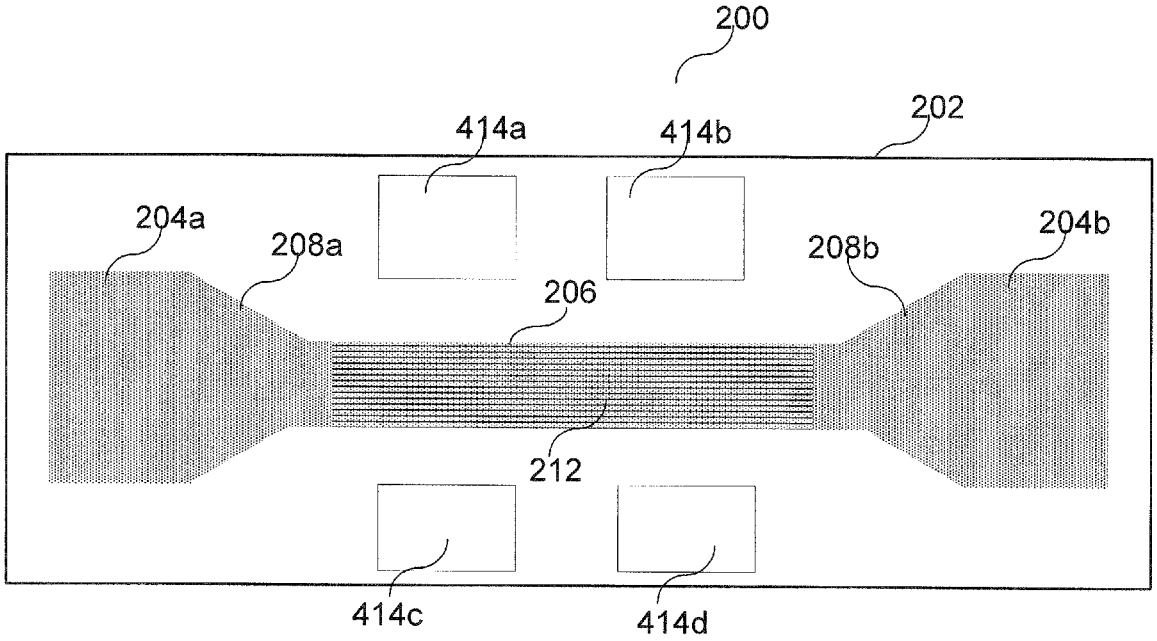
FIG. 4C schematically shows a fuse arrangement in an intact state being under internal mechanical stress including a contact structure, according to various embodiments.
Figure 4D:
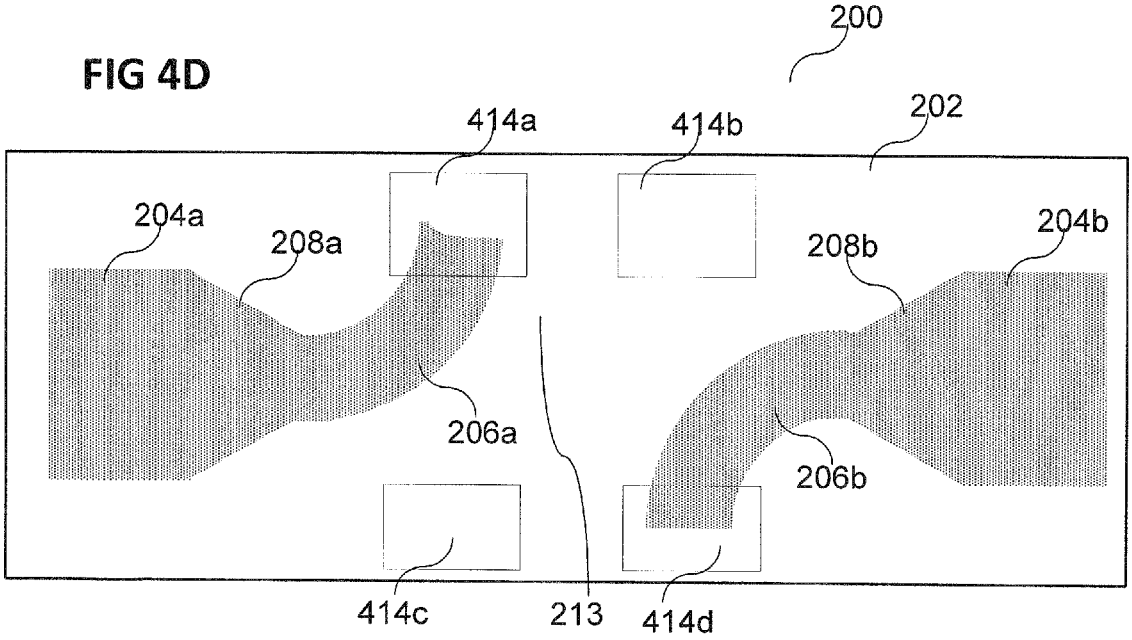
FIG. 4D schematically shows a deformed fuse in a fuse arrangement in a broken state including a contact structure, according to various embodiments.

In analogy to FIG. 4A and FIG. 4B, the fuse arrangement 200 may include a contact structure 414 including more than two individual contacts, e.g. four individual contacts 414*a*, 414*b*, 414*c*, 414*d*, as shown in FIG. 4C and FIG. 4D.

According to various embodiments, the fuse internal mechanical stress 212 may also include a component providing a compression of the fuse (and/or the fuse filament) 206, e.g. along its length direction, and therefore the broken parts 206*a*, 206*b* of the fuse (and/or the fuse filament) 206 in the broken state may deform in opposite direction, but as described, perpendicular to the width direction of the fuse (and/or the fuse filament) 206.

According to various embodiments, a larger number of individual contacts 414*a*, 414*b*, 414*c*, 414*d* included in the contact structure 414 may provide a more detailed determination of the state of the fuse (and/or the fuse filament) 206 and/or the fuse arrangement 200. If for example the fuse (and/or the fuse filament) 206 is detected to be broken, since there may be no current passing between the terminals 204*a*, 204*b* through the fuse (and/or the fuse filament) 206, and at the same time, there may be no electrically conductive connection between at least one of the terminals 204*a*, 204*b* and at least one of the individual contacts 414*a*, 414*b*, 414*c*, 414*d*, the fuse may be broken, but not very reliable or not as intended. According to various embodiments, the fuse (and/or the fuse filament) 206 may be electrically isolated from the individual contacts 414*a*, 414*b*, 414*c*, 414*d* and from the contact structure 414 if the fuse (and/or the fuse filament) 206 is in the intact state. In the case, that the fuse should be in an intact state, e.g. after manufacturing, an electrically conductive connection between at least one of the terminals 204*a*, 204*b* and the contact structure 414, or at least one of the individual contacts 414*a*, 414*b*, 414*c*, 414*d*, may give notice of an error. In other words, the contact structure 414 may be used to detect, whether a manufacturing of the fuse arrangement 200 has worked as intended.

As described above, the contact structure 414 may allow to judge the reliability of the measured state of the fuse (and/or the fuse filament) 206 based on additional measurements of the electrical properties of the fuse arrangement 200.

Figure 5A:
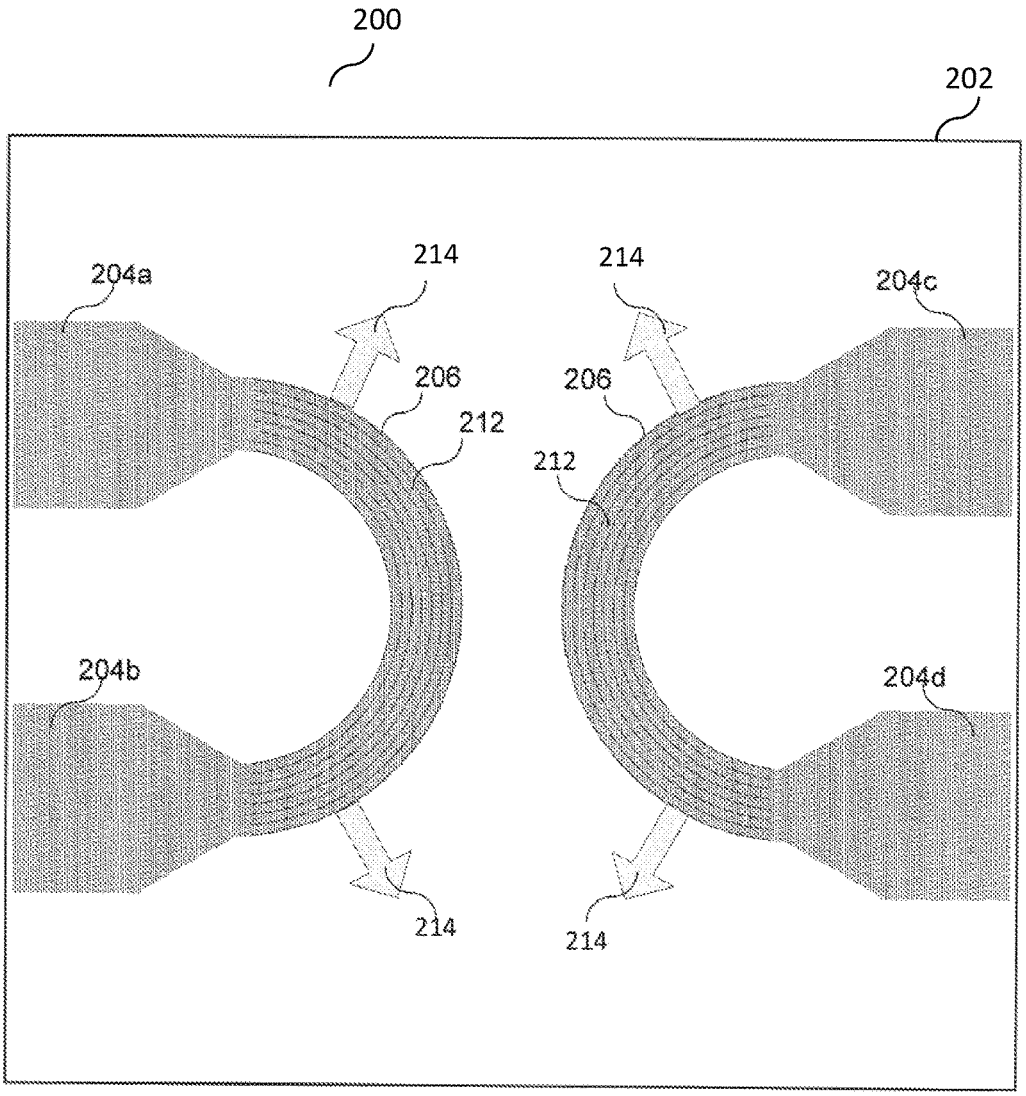
FIG. 5A schematically shows a fuse arrangement in an intact state including a second intact fuse being under internal mechanical stress, according to various embodiments.
Figure 5B:
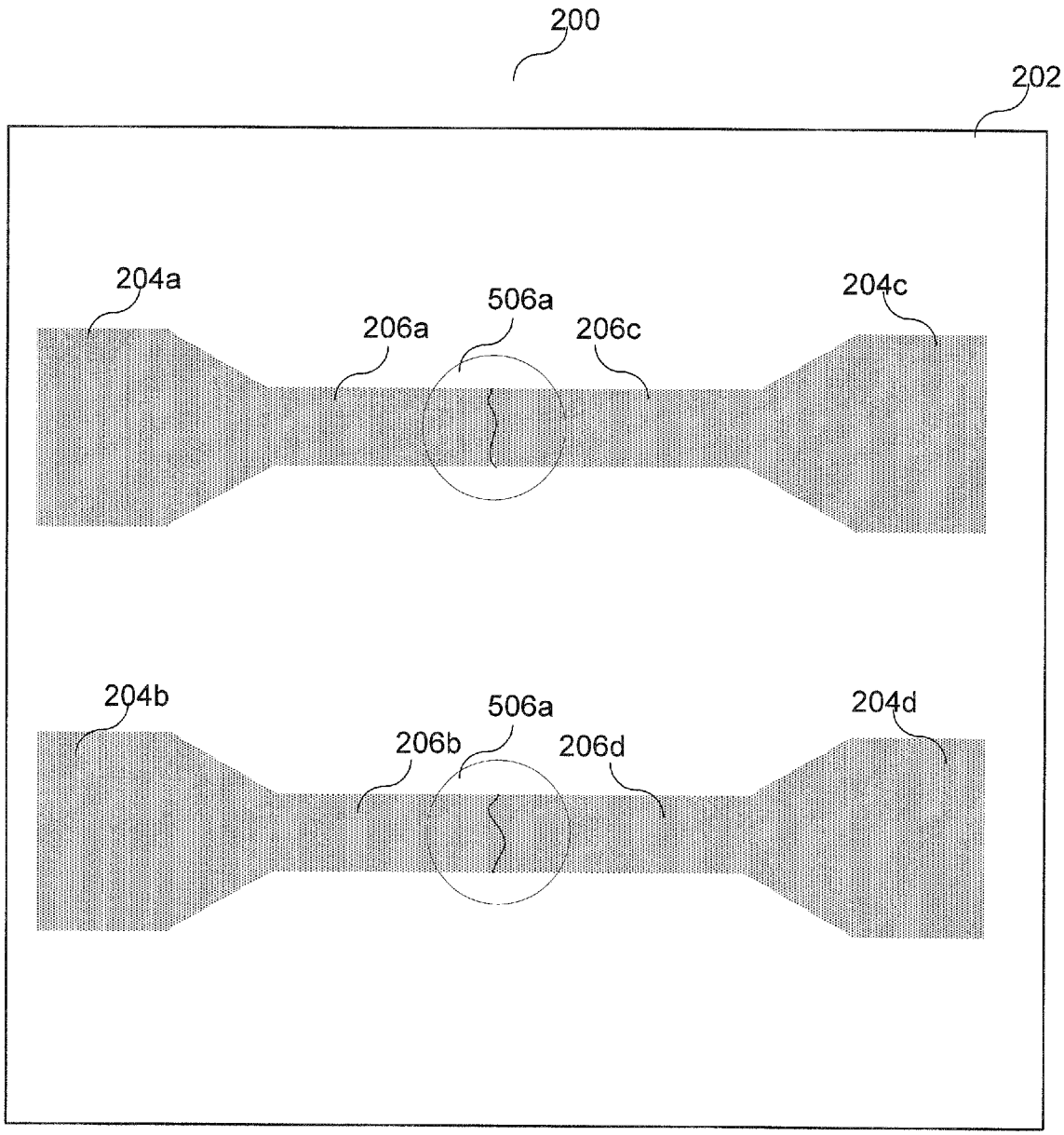
FIG. 5B schematically shows a deformed fuse in a fuse arrangement in a broken state including a second broken fuse, according to various embodiments.

According to various embodiments, the additional contacts may be provided by a part of another fuse 206, as shown in FIG. 5A and FIG. 5B in the following. According to various embodiments, two fuse arrangements 200 may be arranged in such a way, that the fuses 206 may be electrically connected to each other in case both fuses are broken and deformed taking the respective equilibrium shapes, e.g. the broken parts 206*a*, 206*b*, 206*c*, 206*d* of the fuses may have an electrically conductive connection in regions 506*a*, 506*b*.

According to various embodiments, as shown in FIG. 5A, in the case that the fuses are intact, e.g. the first fuse (one the left side) and the second fuse (on the right side), both fuses may be electrically isolated from each other. According to various embodiments, in case one fuse is intact, e.g. the first fuse or the second fuse (not shown), both fuses may be electrically isolated from each other. According to various embodiments, in case one fuse is intact, e.g. the first fuse or the second fuse (not shown), at least one terminal of the first fuse may be electrically connected to at least one terminal of the second fuse.

According to various embodiments, the first fuse and the second fuse may proximate each other due to the deformation of the fuses in case both fuses may be broken. According to various embodiments, the first fuse and the second fuse may proximate each other due to the deformation of at least one fuse in case at least one fuse may be broken.

As shown in FIG. 5B, in case both fuses may be broken as intended, the terminal 204*a* of the first fuse may be electrically conductively connected to the terminal 204*c* of the second fuse and the terminal 204*b* of the first fuse may be electrically conductively connected to the terminal 204*d* of the second fuse.

According to various embodiments, one or more fuses and/or additional contacts may be arranged, e.g. in a fuse array, to provide redundant information about the intended state of the (logical) fuse bit so that it may be assured that the physical fuses have been blown correctly and that any changes of that state over the lifetime may be detected and possibly corrected. According to various embodiments, the connectivity matrix between the contacts (and the terminal) in a fuse arrangement has to be assessed. According to various embodiments, the connectivity matrix should be designed to provide a large Hamming distance between the two desired states and any of failed states, for instance incomplete or improper blowing, re-connect after blow, and the like. According to various embodiments, for Hamming distances larger than 1 single failure states can be corrected to obtain the originally intended state, as it may be known from memory design.

According to various embodiments, the individual contacts of the contact structure 414 may have substantially the same height as the fuse (and/or the fuse filament) 206, measured from the surface of the carrier 202. Therefore, the broken parts 206*a*, 206*b* of the fuse 206 may have the possibility to electrically contact the individual contacts of the contact structure 414 due to the deformation of the fuse (and/or the fuse filament) 206 in case the fuse 206 is broken.

According to various embodiments, the individual contacts of the contact structure 414 may have a larger or smaller height as the fuse (and/or the fuse filament) 206, measured from the surface of the carrier 202 According to various embodiments, the height of the fuse may be substantially equal to the thickness of the fuse material layer, as described above. However, the broken parts 206*a*, 206*b* of the fuse 206 may have the possibility to electrically contact the individual contacts of the contact structure 414 due to the deformation of the fuse (and/or the fuse filament) 206 in case the fuse 206 is broken. According to various embodiments, the contact structure 414 and/or the individual contacts of the contact structure 414 may include or may consist of at least one material of the following group of materials: a metal, a metallic material, an electrically conductive material, aluminium, copper, silver, gold, titanium, transition metal nitrides, titanium nitride, rare earth nitrides, doped silicon, doped polysilicon, carbon, graphene, metal alloys, and the like.

Figure 6:
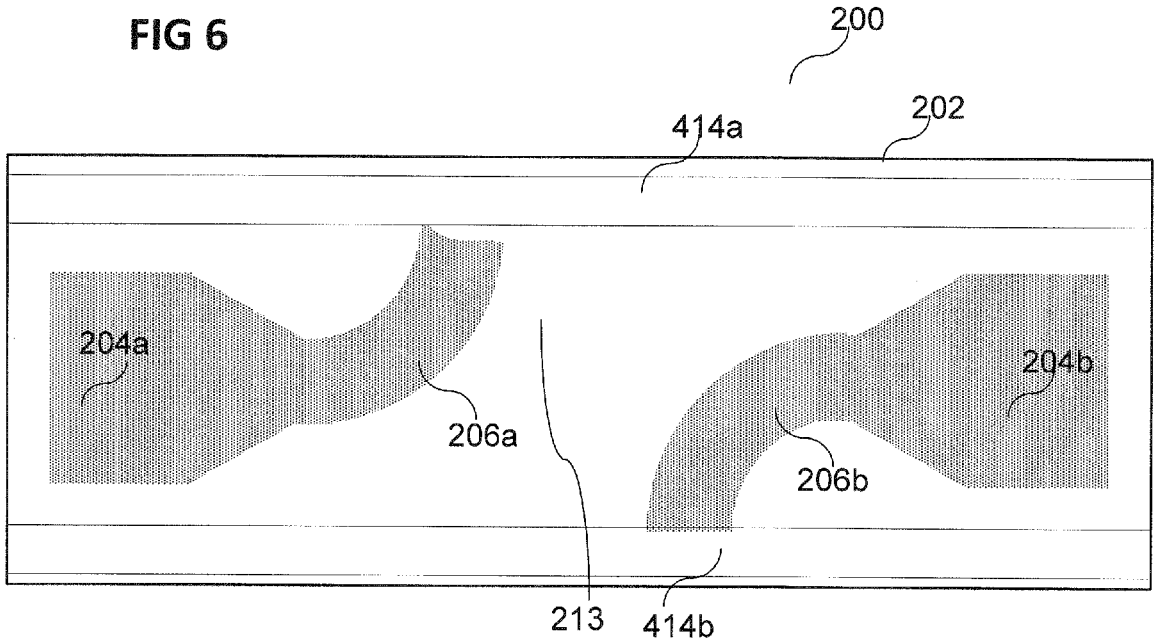
FIG. 6 schematically shows a deformed fuse in a fuse arrangement in a broken state including a contact structure, according to various embodiments.

According to various embodiments, the contact structure 414 may be provided as elongated contacts or long electrodes 414*a*, 414*b* in the surrounding of the fuse (and/or the fuse filament) 206, e.g. being arranged parallel to the fuse (and/or the fuse filament) 206, as shown in FIG. 6.

Figure 7:
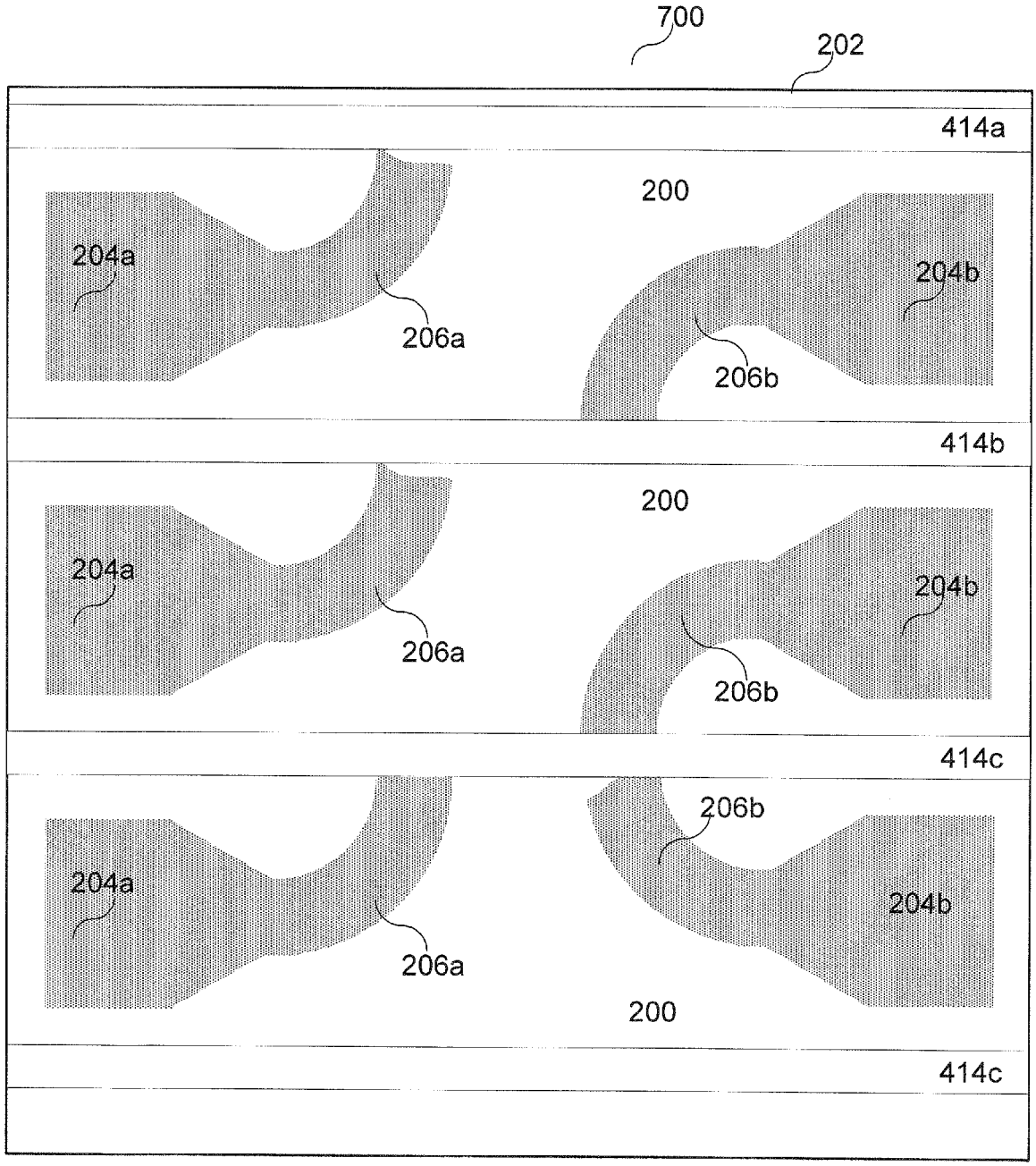
FIG. 7 schematically shows a fuse array including contact structures, wherein the fuses are in a broken state, according to various embodiments.

According to various embodiments, a fuse array 700 may include a contact structure 414 including a plurality of individual contacts, as shown in FIG. 7. According to various embodiments, the individual contacts 414*a*, 414*b*, 414*c* of the contact structure 414 may be arranged between adjacent fuse arrangements 200 such that the fuse arrangements 200 may share at least some of the individual contacts of the contact structure 414. According to various embodiments, the fuse array 700 may include more than 30 fuses, e.g. more than 40, e.g. more than 100, or even up to 1000 fuses, depending on the amount of data to be stored in the fuse array 700. According to various embodiments, the fuse array 700 may allow an easier and more cost efficient processing of a fuse memory structure, wherein the fuse memory structure or the fuse array 700 may be more reliable since the state of the fuses may be determined more accurately.

According to various embodiments, FIG. 7 shows fuse arrangements 200 included in a fuse array 700 each being in a broken state as intended. It should be noted, that in case a fuse (and/or the fuse filament) 206 may not break as intended, the broken parts 206*a*, 206*b* of the fuse 206 may not electrically contact one of the contacts 414*a*, 414*b*, 414*c*. In this case, the contacts 414*a*, 414*b*, 414*c* may serve to determine, if a fuse has not been broken as intended and, therefore, if a fuse may be judged as unreliable.

According to various embodiments, the fuse array 700 as shown in FIG. 7 may be a fuse testing arrangement or at least a part of a fuse testing arrangement. According to various embodiments, a fuse testing arrangement may include at least one fuse arrangement 200, as described herein, e.g. including at least one contact structure 414 configured to provide an interface to an evaluation circuit to determine the state of the fuse (and/or the fuse filament) 206; and at least one evaluation circuit (not shown in detail) to measure the electrical resistance between the terminal and the contact structure of the at least one fuse arrangement to determine the state of the fuse. According to various embodiments, a fuse testing arrangement may be used to determine the optimal design of a fuse arrangement 200 or of a fuse (and/or the fuse filament) 206. Further, since the fuse testing arrangement may include a contact structure, the fuse testing arrangement may be utilized to determine the optimal properties of the current which has to be applied to break the fuse. According to various embodiments, the fuse testing arrangement based on the fuse arrangement 200, as described herein, may be used to investigate fusing processes and electrical and mechanical properties of a fuse or a fuse arrangement 200 to realize a reliable fusing and, therefore, a reliable storage of data within a fuse array.

According to various embodiments, an evaluation circuitry may include measurement systems being useful for determining electrical properties of the fuse arrangement 200.

Figure 8:
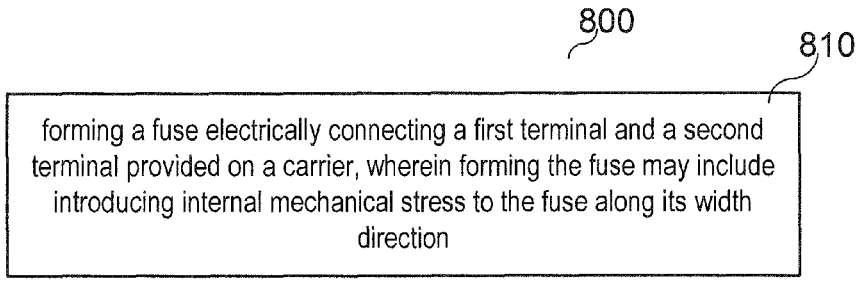
FIG. 8 schematically shows a process flow diagram of a method for manufacturing a fuse arrangement, according to various embodiments.

FIG. 8 schematically shows a flow diagram of a method 800 for manufacturing a fuse arrangement 200, according to various embodiments. According to various embodiments, the method 800 for manufacturing a fuse arrangement 200 may include, in 810, forming a fuse (and/or the fuse filament) 206 electrically connecting a first terminal 204*a* and a second terminal 204*b* provided on a carrier 202, wherein forming the fuse (and/or the fuse filament) 206 may include introducing internal mechanical stress to the fuse (and/or the fuse filament) 206 along the width direction of the fuse (and/or the fuse filament) 206, as described herein.

Figure 9:
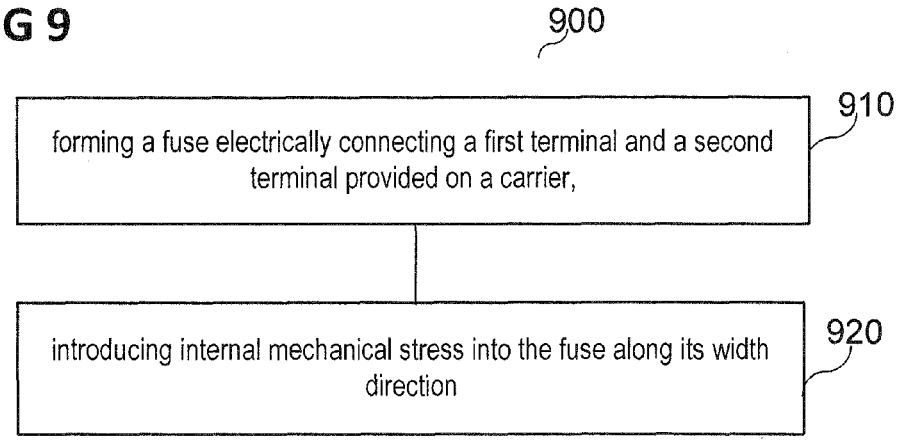
FIG. 9 schematically shows a process flow diagram of a method for manufacturing a fuse arrangement, according to various embodiments.

According to various embodiments, a method for manufacturing a fuse arrangement 200 may also be performed as illustrated in FIG. 9. According to various embodiments, FIG. 9 schematically shows a flow diagram of a method 900 for manufacturing a fuse arrangement 200. According to various embodiments, the method 900 for manufacturing a fuse arrangement 200 may include, in 910, forming a fuse (and/or the fuse filament) 206 electrically connecting a first terminal 204*a* and a second terminal 204*b* provided on a carrier 202; and, in 920, introducing internal mechanical stress to the fuse (and/or the fuse filament) 206 along the width direction of the fuse (and/or the fuse filament) 206, as described herein.

As already described herein, the method 900 for manufacturing a fuse arrangement 200 may further include forming at least one contact structure 414 configured to provide an interface to an evaluation circuit to determine the state of the fuse (and/or the fuse filament) 206.

Figure 10:
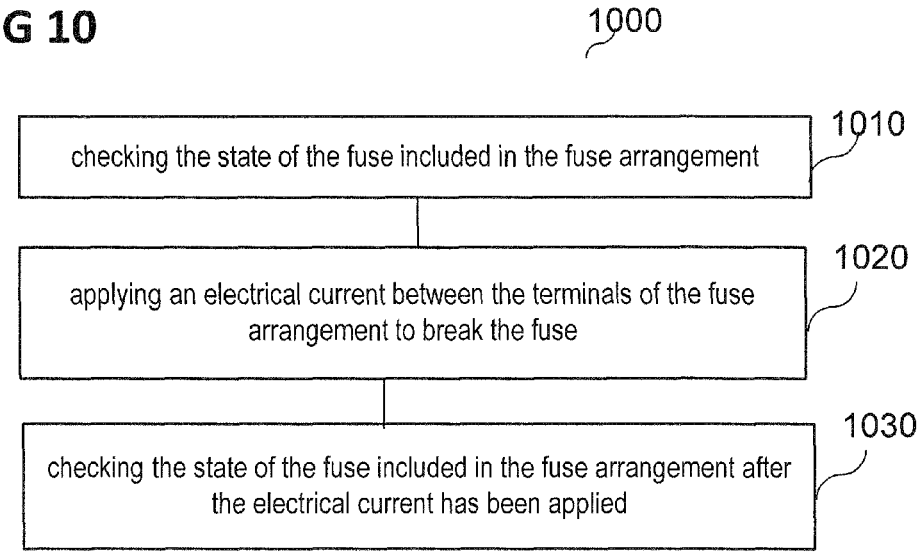
FIG. 10 schematically shows a process flow diagram of a method for operating a fuse arrangement, according to various embodiments.

FIG. 10 schematically shows a flow diagram of a method 1000 for operating a fuse arrangement 200 (or a fuse array 700), according to various embodiments. According to various embodiments, the method 1000 for operating a fuse arrangement 200 (or a fuse array 700) may include, in 1010, checking the state of the fuse 206 included in the fuse arrangement 200; in 1020, applying an electrical current between the terminals 204*a*, 204*b* of the fuse arrangement 200 to break the fuse 206; and, in 1030, checking the state of the fuse 206 included in the fuse arrangement 200 after the electrical current has been applied.

According to various embodiments, checking the state of the fuse 206 included in the fuse arrangement 200 may be performed for example to check the state of the fuse before programming of the fuse, e.g. checking the state of the fuse (and/or the fuse filament) 206 after manufacturing to assure that the fuse may work properly.

According to various embodiments, applying an electrical current between the terminals 204*a*, 204*b* of the fuse arrangement 200 to break the fuse (and/or the fuse filament) 206 may be used to program the fuse 206 or to program the fuse array 700. According to various embodiments, applying an electrical current between the terminals 204*a*, 204*b* of the fuse arrangement 200 may include applying a predetermined current, e.g. in the range of several microampere up to one ampere. According to various embodiments, applying an electrical current between the terminals 204*a*, 204*b* of the fuse arrangement 200 may include applying a predetermined current, e.g. for a duration in the range of several microseconds up to seconds. According to various embodiments, checking the state of the fuse (and/or the fuse filament) 206 included in the fuse arrangement 200 after the electrical current has been applied may serve to assure, whether the fuse (and/or the fuse filament) 206 may be in the state as intended, e.g. a broken fuse 206 should not carry a current and an intact fuse should carry the predefined checking current.

Since there may be one or more contacts available in the fuse arrangement 200 or in a fuse array 700, checking the state of a fuse may include determine the electrical resistance between at least one of the first terminal and the second terminal and the one or more contacts.

There may be a large number of possibilities for performing an error analysis using the additional contacts of the contact structure 414*a*, 414*b* for evaluation, whether the determined state of the fuse 206 (logic "1" or logic "0") may be a reliable state and/or whether the fuse is in the state as intended.

Figure 11:
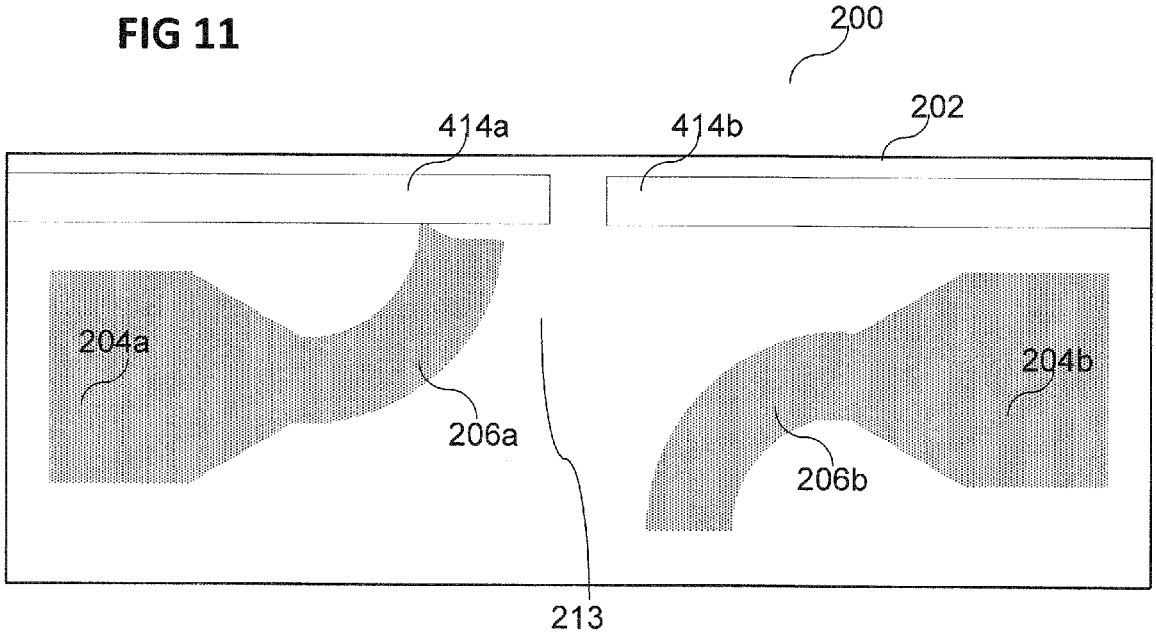
FIG. 11 schematically shows a fuse array including a contact structure and a corresponding connection matrix, according to various embodiments.

FIG. 11 illustrates a simplified example of such an analysis considering the electrical connections between the fuse (and/or the fuse filament) 206, the terminals 204*a*, 204*b* and the two contacts 414*a*, 414*b*, as already described. The evaluation circuit may determine, whether there may be an electrically conductive connection between respectively two of the terminal 204*a*, the terminal 204*b*, and the contacts 414*a*, 414*b*. According to various embodiments, the different cases (combinations or possible results) taken into account may be reduced to an appropriate number, because several cases may be highly unlikely or may be generated by an error of the evaluation circuit or another defect outside of the fuse.

After a fuse or a fuse arrangement has been manufactured, the initial state of a fuse may be or should be a logic "1" which means that the fuse may be or should be intact (not broken). As shown in the table 1100 in FIG. 11, there may be several possible errors determined by the evaluation circuit checking the actual state of the fuse. According to various embodiments, the evaluated errors, e.g. shown in the second column of table 1100, may result from analyzing the following electrical connections: first, the electrical connection C(204*a*-204*b*) between terminal 204*a* and terminal 204*b*, second, the electrical connection C(204*a*-414*a*) between terminal 204*a* and contact 414*a*; thirdly, the electrical connection C(204*b*-414*b*) between terminal 204*b* and contact 414*b*, fourthly, the electrical connection C(204*a*-414*b*) between terminal 204*a* and contact 414*b*, fifthly, the electrical connection C(204*b*-414*a*) between terminal 204*b* and contact 414*a* and, sixthly, the electrical connection C(414*a*-414*b*) between contact 414*a* and contact 414*b*.

According to various embodiments, if the fuse may be evaluated as intact, representing the state "1" and no error is determined ("1"), the terminals 204*a* and 204*b* may be electrically connected with each other ("yes"), and there may be no other electrical connections ("no") between the terminals 204*a*, 204*b* and the contacts 414*a*, 414*b* or between the contacts 414*a*, 414*b*. According to various embodiments, in all other cases for the electrical connections the information may be provided, that the fuse 206 may have an error being not in the initial state "1" as desired and/or not in a reliable state (e.g. state "1" having no error "1"), wherein the states "D" of the fuse may be assigned to an occurring error ("F0", "E0", "F", "0"). According to various embodiments, a fuse being not in the initial state "1" as desired may be sorted-out after the manufacturing process.

According to various embodiments, the assignment of the errors ("F0", "E0", "F", "0") to the respective evaluated electrical connections may be a part of an error analysis, considering the likelihood of several combinations of evaluated electrical connections. According to various embodiments, in one exemplary evaluation process, as shown in FIG. 11, the Hamming-Distance may be larger than or equal to 2 for the case of a correctable error. According to various embodiments, the errors indicated with "F" may be a non correctable error. In this case, there may be no reliable information which may allow judging the state of the fuse. Further, according to various embodiments, the error indicated with "F0" may arise from a logical "0" (a broken state "0" of the fuse). Further, according to various embodiments, the error indicated with "E0" may be a correctable error corresponding to a logical "0" (a broken state "0" of the fuse). According to various embodiments, depending on the error analysis and the interpretation of the results provided by the evaluation circuit, and on the underlying reliablity, errors indicated with "F0" may be judged as correctable errors. According to various embodiments, the error correction may further by extended using redundant bits.

For sake of brevity the error analysis may not be described in detail, since common modifications and/or modifications of such an error correction may be obvious to a person skilled in the art.

According to various embodiments, the fuse arrangement 200, the fuse array 700, and the fuse testing arrangement based on the described fuse arrangement 200, as described herein, may be space saving compared to common reliable fuse arrangements, e.g. fuses being laser programmed.

According to various embodiments, the fuse arrangement 200, the fuse array 700, and the fuse testing arrangement based on the described fuse arrangement 200, as described herein, may provide a reliable fuse arrangement, which may be integrated into a chip or integrated circuit, e.g. being not exposed to the environment.

According to various embodiments, the fuse arrangement 200, the fuse array 700, and the fuse testing arrangement based on the described fuse arrangement 200, as described herein, may provide a fuse arrangement, which may be programmed using electrical current and avoiding problems concerning the reliability, e.g. stability over time.

According to various embodiments, the fuse arrangement 200, the fuse array 700, and the fuse testing arrangement based on the described fuse arrangement 200, as described herein, may provide a fuse arrangement which may be programmed using a current and which may provide the possibility to evaluate the reliability of the state of the fuse.

According to various embodiments, the fuse (and/or the fuse filament) 206 may be improved providing a better performance referring to common fuses, e.g. having a more predictable breaking behavior or breaking by a lower energy input. According to various embodiments, the fuse (and/or the fuse filament) 206 may break without evaporating fuse material. According to various embodiments, the fuse (and/or the fuse filament) 206 may break without evaporating a substantial amount of fuse material. According to various embodiments, the fuse (and/or the fuse filament) 206 may break without creating debris or without creating a substantial amount of debris.

According to various embodiments, the fuse arrangement 200, the fuse array 700, and the fuse testing arrangement based on the described fuse arrangement 200, as described herein, may have a larger lifetime in use, since the fuses may be checked using the evaluation circuit such that fuses or fuse arrays including significant errors may not be circulated.

According to various embodiments, breaking a fuse may also be regarded as fusing, blowing, or melting a fuse or a fuse filament.

According to various embodiments, the fuse (and/or the fuse filament) 206 may be mechanically loaded.

According to various embodiments, an additional layer may be arranged between the fuse (and/or the fuse filament) 206 and the carrier 202, e.g. reducing the adhesion of the fuse (and/or the fuse filament) 206 on the carrier 202. According to various embodiments, an additional layer may be arranged between the fuse (and/or the fuse filament) 206 and the carrier 202, e.g. proving a thermal isolation between the carrier 202 and the fuse (and/or the fuse filament) 206.

According to various embodiments, a bather layer, e.g. TiN, may be arranged between the fuse (and/or the fuse filament) 206 and the carrier 202. According to various embodiments, an additional oxide layer may be arranged between the fuse (and/or the fuse filament) 206 and the carrier 202.

According to various embodiments, the fuse internal mechanical stress, load, and/or strain may be introduced into the fuse (and/or the fuse filament) 206 by controlling the deposition parameter for forming the fuse material layer, e.g. deposition temperature, e.g. pressure during deposition, e.g. precursor composition in CVD processes, and e.g. reaction or growth speed.

According to various embodiments, forming a fuse arrangement 200 may include depositing a conformal layer or a plurality of conformal layers over a carrier structure such that a metal spacer or an electrically conductive spacer may be formed, wherein the electrically conductive spacer may provide at least a part of the fuse (and/or the fuse filament) 206.

According to various embodiments, the fuse arrangement 200 may be used for investigating and optimizing the fusing process, since due to the contact structure the fusing result may be evaluated.

According to various embodiments, if the fuse (and/or the fuse filament) 206 includes silicon, the fusing current may be a more complex current to break the fuse.

According to various embodiments, the fuse (and/or the fuse filament) 206 may be exposed using a plasma etch process removing carrier material and or carrier structure material in the surrounding of the fuse (and/or the fuse filament) 206.

According to various embodiments, exposing the fuse or providing a partially freestanding fuse (and/or the fuse filament) 206 may enable to define, thermally induced, a predetermined breaking point.

According to various embodiments, a method for forming a fuse arrangement 200 or a method for forming a fuse (and/or the fuse filament) 206 may include one or more layering processes, one or more patterning processes (e.g. lithography and etching), cleaning processes, doping processes, annealing processes and the like being part of the common semiconductor processing.

According to various embodiments, the fuse (and/or the fuse filament) 206 provided in the fuse arrangement 200, as described herein, may not be exposed to the ambient, and therefore, the fuse (and/or the fuse filament) 206 may be protected from external influences. According to various embodiments, the fuse arrangement 200 may be covered with a protection layer.

According to various embodiments, a fuse arrangement, may include: at least a first terminal, a second terminal, and a fuse, wherein the first terminal and the second terminal may be electrically connected via the fuse, and wherein the fuse may be configured to be under fuse internal mechanical stress to deform the fuse along its width direction in case the fuse is broken.

According to various embodiments, the fuse may include a fuse filament to provide the electrical connection of the terminals, wherein an extension of the fuse filament along an electrically conducting path connecting the terminals may be larger or significantly larger than the extension of the fuse filament along a direction perpendicular to the electrically conducting path connecting the terminals of the fuse arrangement.

According to various embodiments, the length of the fuse may be smaller than or equal to about 300 μm.

According to various embodiments, the width of the fuse may be smaller than or equal to about 10 μm.

According to various embodiments, the fuse arrangement 200 may further include: a carrier carrying at least one of the first terminal, the second terminal, and the fuse.

According to various embodiments, the carrier may be a semiconductor wafer.

According to various embodiments, the fuse may include a predetermined breaking point.

According to various embodiments, the fuse may include a metal.

According to various embodiments, the fuse may include doped silicon.

According to various embodiments, the fuse arrangement may further include: a gap between a portion of the fuse (and/or the fuse filament) and the carrier.

According to various embodiments, at least a portion of the fuse (and/or the fuse filament) may have a low adhesion to the carrier such that the fuse (and/or the fuse filament) may be released from the carrier in case the fuse is broken.

According to various embodiments, the fuse (and/or the fuse filament) may be formed by a sidewall spacer.

According to various embodiments, at least part of the fuse (and/or the fuse filament) may be formed by a sidewall spacer.

According to various embodiments, the fuse arrangement 200 may further include: at least one contact structure configured to provide an interface to an evaluation circuit to determine the state of the fuse.

According to various embodiments, the at least one contact structure may be configured to allow measuring of an electrical resistance between the terminals and the least on contact structure to determine the state of the fuse via the evaluation circuit.

According to various embodiments, the at least one contact structure may include a plurality of individual contacts.

According to various embodiments, the plurality of individual contacts may be configured to allow measuring of an electrical resistance between at least two contacts of the plurality of individual contacts to determine the state of the fuse via the evaluation circuit.

According to various embodiments, the fuse may be deformed along a deformation vector in case the fuse is broken, wherein a vector component of the deformation vector may be perpendicular to the length direction of the fuse.

According to various embodiments, the fuse may be deformed along a deformation vector in case the fuse is broken, wherein a vector component of the deformation vector may be perpendicular to the length direction of the fuse and parallel to the surface of the carrier.

According to various embodiments, the fuse may be deformed along a deformation vector in case it is broken, wherein a vector component of the deformation vector may be perpendicular to the length direction of the fuse and perpendicular to the surface of the carrier.

According to various embodiments, a fuse arrangement 200 may further include: a third terminal, a fourth terminal, and a second fuse, wherein the third terminal and the fourth terminal may be electrically connected via the second fuse, wherein the second fuse may be configured to be under fuse internal mechanical stress to deform the second fuse along its width direction in case the fuse is broken. According to various embodiments, the fuse arrangement 200 may include more than one fuse (and/or the fuse filaments) 206. According to various embodiments, the fuse arrangement 200 may include more than two terminals. According to various embodiments, the fuse arrangement 200 may include more than one fuse (and/or the fuse filaments) 206 and more than two terminals.

According to various embodiments, the first fuse and the second fuse may be electrically isolated from each other. According to various embodiments, the first fuse and the second fuse may be electrically isolated from each other in case both fuses may be intact. According to various embodiments, the first fuse and the second fuse may be electrically isolated from each other in case at least one of the fuses is intact.

According to various embodiments, the first fuse and the second fuse may be arranged in such a way that the first fuse and the second fuse proximate each other due to the deformation of the fuses in the case both fuses are broken.

According to various embodiments, the first fuse and the second fuse may be arranged in such a way that the first fuse and the second fuse proximate each other due to the deformation of the fuses in case at least one of the fuses are broken.

According to various embodiments, at least one of the first terminal and the second terminal may be electrically connected to at least one of the third terminal and the fourth terminal due to the deformation of the fuses in case both fuses are broken.

According to various embodiments, at least one of the first terminal and the second terminal may be electrically connected to at least one of the third terminal and the fourth terminal due to the deformation of the fuses in case at least one of the fuses may be broken.

According to various embodiments, a fuse testing arrangement may include: at least one fuse arrangement, the at least one fuse arrangement including: at least a first terminal, a second terminal, and a fuse, wherein the first terminal and the second terminal may be electrically connected via the fuse, wherein the fuse may be configured to be under fuse internal mechanical stress to deform the fuse along its width direction in case the fuse is broken; at least one contact structure configured to provide an interface to an evaluation circuit to determine the state of the fuse; and at least one evaluation circuit to measure the electrical resistance between at least one of the first terminal and the second terminal and the contact structure of the at least one fuse arrangement to determine the state of the fuse.

According to various embodiments, a fuse array may include: at least a plurality of fuse arrangements, each fuse arrangement of the plurality of fuse arrangements may include: at least a first terminal, a second terminal, and a fuse, wherein the first terminal and the second terminal may be electrically connected via the fuse, wherein the fuse may be configured to be under fuse internal mechanical stress to deform the fuse along its width direction in case it is broken.

According to various embodiments, a fuse array may include: a plurality of fuse arrangements 200. According to various embodiments, a fuse array may include: a plurality of fuse arrangements 200 and a plurality of contact structures.

According to various embodiments, a fuse array may further include: one or more contact structures configured to provide at least one interface to an evaluation circuit to determine the state of at least one fuse of the plurality of fuses included in the plurality of fuse arrangements.

According to various embodiments, each fuse of the plurality of fuses in a fuse array may be electrically isolated from the one or more contact structures in case the fuse is intact.

According to various embodiments, a method for manufacturing a fuse arrangement may include forming a fuse electrically connecting a first terminal and a second terminal provided on a carrier, wherein forming the fuse may include introducing internal mechanical stress to the fuse along its width direction.

According to various embodiments, a method for manufacturing a fuse arrangement may include forming at least one contact structure configured to provide an interface to an evaluation circuit to determine the state of the fuse.

According to various embodiments, a method for operating a fuse arrangement may include: checking the state of the fuse included in the fuse arrangement, applying an electrical current between the terminals of the fuse arrangement to break the fuse, and checking the state of the fuse included in the fuse arrangement after the electrical current has been applied.

According to various embodiments, checking the state of the fuse may include determining the electrical resistance between at least one of the first terminal and the second terminal and the contact structure.

According to various embodiments, a method for operating the fuse arrangement 200, as described herein, may include: checking the state of the fuse included in the fuse arrangement, applying an electrical current between the terminals of the fuse arrangement to break the fuse, and checking the state of the fuse included in the fuse arrangement after the electrical current has been applied.

According to various embodiments, a method for manufacturing a fuse arrangement 200, as described herein, may include forming a fuse electrically connecting a first terminal and a second terminal provided on a carrier, wherein forming the fuse may include introducing internal mechanical stress to the fuse along its width direction.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A fuse arrangement, comprising:

at least a first terminal, a second terminal, and a fuse;

a carrier, wherein the first terminal, the second terminal, and the fuse are arranged over a surface of the carrier;

wherein in an intact state, the fuse extends along a first direction electrically connecting the first terminal to the second terminal, and wherein the fuse is under fuse internal mechanical stress, the fuse internal mechanical stress applying an internal force to cause the fuse to deform along a second direction in a case where the fuse is broken, wherein in a broken state, the fuse comprises a first broken fuse part connected to the first terminal and a second broken fuse part connected to the second terminal, wherein the first broken fuse part and the second broken fuse part are physically and electrically separated from each other, and wherein the second direction is perpendicular to the first direction, and wherein the first and second directions are parallel to the surface of the carrier.

2. The fuse arrangement according to claim 1, wherein the fuse comprises a fuse filament providing an electrical connection between the terminals, wherein a length of an extension of the fuse filament along the first direction is longer than a width of the extension of the fuse filament along the second direction.

3. The fuse arrangement according to claim 1, wherein the length of the fuse is smaller than or equal to about 300 μm.

4. The fuse arrangement according to claim 1, wherein the width of the fuse is smaller than or equal to about 10 μm.

5. The fuse arrangement according to claim 1, wherein the carrier is a semiconductor wafer.

6. The fuse arrangement according to claim 1,
wherein the fuse comprises a predetermined breaking point.

7. The fuse arrangement according to claim 1,
wherein the fuse comprises a metal.

8. The fuse arrangement according to claim 1,
wherein the fuse comprises doped silicon.

9. The fuse arrangement according to claim 1, further comprising:
a gap between a portion of the fuse and the carrier.

10. The fuse arrangement according to claim 1,
wherein at least a portion of the fuse has a low adhesion to the carrier such that the fuse is released from the carrier in case it is broken.

11. The fuse arrangement according to claim 1,
wherein the fuse is formed by a sidewall spacer.

12. The fuse arrangement of claim 1, further comprising:
at least one contact structure providing an interface to an evaluation circuit to determine the state of the fuse.

13. The fuse arrangement according to claim 12,
wherein the at least one contact structure comprises a plurality of individual contacts.

14. The fuse arrangement according to claim 1,
wherein the first broken fuse part and the second broken fuse part are each deformed along a deformation vector, wherein a vector component of the deformation vector is parallel to the direction of the fuse.

15. The fuse arrangement according to claim 1, further comprising:
a third terminal, a fourth terminal, and a second fuse;
wherein in an intact state,
the second fuse extends along a third direction to electrically connect the third terminal to the fourth terminal, and wherein the second fuse is under fuse internal mechanical stress, the fuse internal mechanical stress applying an internal force to cause the second to deform along a fourth direction in a case it where the second fuse is broken,
wherein in a broken state,
the second fuse comprises a first broken fuse part connected to the third terminal and a second broken fuse part connected to the fourth terminal, wherein the first broken fuse part and the second broken fuse part are physically and electrically separated from each other, and
wherein the third direction is perpendicular to the fourth direction.

16. The fuse arrangement according to claim 15,
wherein the first fuse and the second fuse are electrically isolated from each other when the first fuse and the second fuse are both in the intact state.

17. The fuse arrangement according to claim 15,
wherein the first fuse and the second fuse are arranged in such a way that the first fuse and the second fuse proximate each other due to the deformation of the fuses in case the first fuse and second fuses are each in the broken state.

18. The fuse arrangement according to claim 17,
wherein at least one of the first terminal and the second terminal is electrically connected to at least one of the third terminal and the fourth terminal due to the deformation of the fuses in case the first and second fuses are each in the broken state.

19. The fuse arrangement of claim 1, wherein the first broken fuse part and the second broken fuse part are deformed parallel to the surface of the carrier away from the first direction.

20. A fuse testing arrangement comprising:
at least one fuse arrangement, the at least one fuse arrangement comprising:
at least a first terminal, a second terminal, and a fuse,
a carrier, wherein the first terminal, the second terminal, and the fuse are arranged over a surface of the carrier;
at least one contact structure providing an interface to at least one evaluation circuit to determine the state of the fuse;
wherein in an intact state the fuse extends along a first direction electrically connecting the first terminal to the second terminal, wherein the fuse is under fuse internal mechanical stress, the fuse internal mechanical stress applying an internal force to cause the fuse to deform along a second direction in a case where the fuse is broken,
wherein in a broken state, the fuse comprises a first broken fuse part connected to the first terminal and a second broken fuse part connected to the second terminal, wherein the first broken fuse part and the second broken fuse part are physically and electrically separated from each other, and;
wherein the at least one evaluation circuit measures the electrical resistance between at least one of the first terminal and the second terminal and the contact structure of the at least one fuse arrangement to determine the state of the fuse, and
wherein the second direction is perpendicular to the first direction, and wherein the first and second directions are parallel to the surface of the carrier.

21. A fuse array comprising:
a plurality of fuse arrangements, each fuse arrangement of the plurality of fuse arrangements comprising:
at least a first terminal, a second terminal, and a fuse;
a carrier, wherein the first terminal, the second terminal, and the fuse are arranged over a surface of the carrier,
wherein in an intact state the fuse extends along a first direction electrically connecting the first terminal to the second terminal, and
wherein the fuse is under fuse internal mechanical stress, the fuse internal mechanical stress applying an internal force to cause the fuse to deform along a second direction in a case where the fuse is broken,
wherein in a broken state, the fuse comprises a first broken fuse part connected to the first terminal and a second broken fuse part connected to the second terminal, wherein the first broken fuse part and the second broken fuse part are physically and electrically separated from each other, and
wherein the second direction is perpendicular to the first direction, and
wherein the first and second directions are parallel to the surface of the carrier.

22. The fuse array according to claim 21, further comprising:
one or more contact structures providing at least one interface to an evaluation circuit to determine the state of at least one fuse of the plurality of fuses included in the plurality of fuse arrangements.

23. The fuse array according to claim 21,
wherein each fuse of the plurality of fuses is electrically insulated from the one or more contact structures in case the fuse is intact.

* * * * *